US009420676B2

(12) United States Patent
Chen et al.

(10) Patent No.: US 9,420,676 B2
(45) Date of Patent: Aug. 16, 2016

(54) INSTALLATION CASE FOR RADIATION DEVICE, OIL-COOLING CIRCULATION SYSTEM AND X-RAY GENERATOR

(71) Applicants: Nuctech Company Limited, Haidian District, Beijing (CN); Tsinghua University, Haidian District, Beijing (CN)

(72) Inventors: Zhiqiang Chen, Beijing (CN); Ziran Zhao, Beijing (CN); Fuhua Ding, Beijing (CN); Wanlong Wu, Beijing (CN); Xilei Luo, Beijing (CN); Zhimin Zheng, Beijing (CN)

(73) Assignees: Nuctech Company Limited, Haidian District, Beijing (CN); Tsinghua University, Haidian District, Beijing (CN)

( * ) Notice: Subject to any disclaimer, the term of this patent is extended or adjusted under 35 U.S.C. 154(b) by 104 days.

(21) Appl. No.: 14/129,617

(22) PCT Filed: Dec. 31, 2012

(86) PCT No.: PCT/CN2012/088089

§ 371 (c)(1),
(2) Date: Dec. 27, 2013

(87) PCT Pub. No.: WO2013/102427

PCT Pub. Date: Jul. 11, 2013

(65) Prior Publication Data

US 2014/0211923 A1 Jul. 31, 2014

(30) Foreign Application Priority Data

Jan. 6, 2012 (CN) ..... 2012 1 0003988

(51) Int. Cl.
*H05G 1/02* (2006.01)
*H05G 1/04* (2006.01)
(Continued)

(52) U.S. Cl.
CPC ..... *H05G 1/025* (2013.01); *H01J 35/16* (2013.01); *H05G 1/02* (2013.01); *H05G 1/04* (2013.01); *G21F 5/015* (2013.01)

(58) Field of Classification Search
CPC ..... H01J 35/02; H01J 35/025; H01J 35/16; H01J 35/165; H01J 35/18; H05G 1/02; H05G 1/025; H05G 1/04
USPC ..... 378/121, 203, 130, 141, 200
See application file for complete search history.

(56) References Cited

U.S. PATENT DOCUMENTS 6,062,731 A * 5/2000 Guzik ..... H01J 35/16 378/200
6,213,639 B1 * 4/2001 Hell ..... H01J 35/106 378/200

(Continued)

FOREIGN PATENT DOCUMENTS

CN 1994027 A 7/2007
CN 101128081 A 2/2008

(Continued)

OTHER PUBLICATIONS

International Search Report for corresponding International Patent Application No. PCT/CN2012/088089 mailed Apr. 18, 2013.

*Primary Examiner* — Allen C. Ho
(74) *Attorney, Agent, or Firm* — Merchant & Gould P.C.

(57) ABSTRACT

Disclosed are an installation case for a radiation device, an oil-cooling circulation system and an X-ray generator which belong to the technical field of X-ray generator. This disclosure aims to solve the technical problems existing in the conventional X-ray generator, that is, the conventional X-ray generator provides bad sealing, the weight of the case body of the conventional X-ray generator is heavy, and the leakage dose of the X-ray in the conventional X-ray generator is large. The installation case for a radiation device according to this disclosure comprising a case body and a collimator fixedly connected with the case body, the collimator being provided with a beam exit aperture and the case body being provided with a beam exit opening, the installation case for a radiation device further comprises a shielding device provided within the case body, the collimator and the shielding device are integrally formed, or the collimator and the shielding device are two separate parts and are fixedly connected with each other; each layer of the shielding device is provided with a ray exit aperture, and the ray exit aperture, the beam exit aperture and the beam exit opening are coaxial. The X-ray generator according to this disclosure comprises the oil-cooling circulation system according to this disclosure. The installation case for a radiation device according to the disclosure provides improved sealing and ray leakage-proof performance.

14 Claims, 9 Drawing Sheets

(51) Int. Cl.
*H01J 35/16* (2006.01)
*G21F 5/015* (2006.01)

(56) References Cited

U.S. PATENT DOCUMENTS 6,215,852 B1 * 4/2001 Rogers ..... H01J 35/105 378/141
6,252,937 B1 * 6/2001 Snyder ..... H01J 35/06 313/30
6,257,762 B1 * 7/2001 Guzik ..... H05G 1/02 205/131
6,352,363 B1 * 3/2002 Munger ..... H05G 1/04 378/203
6,457,859 B1 * 10/2002 Lu ..... H05G 1/04 378/130
6,592,258 B2 * 7/2003 Chabin ..... H05G 1/04 378/195
6,619,842 B1 * 9/2003 Artig ..... H01J 35/10 378/140
6,639,969 B2 * 10/2003 Ochiai ..... H01J 3/028 378/101
6,749,337 B1 * 6/2004 Artig ..... H01J 35/16 378/121
7,031,433 B2 * 4/2006 Suzuki ..... H05G 1/06 378/102
7,072,439 B2 * 7/2006 Radley ..... G01N 23/12 378/47
7,079,624 B1 * 7/2006 Miller ..... H05G 1/025 252/512
7,104,690 B2 * 9/2006 Radley ..... H05G 1/54 378/207
7,118,275 B2 * 10/2006 Chabin ..... H05G 1/04 378/197
7,257,193 B2 * 8/2007 Radley ..... H05G 1/025 378/108
7,290,929 B2 * 11/2007 Smith ..... H05G 1/02 378/121
7,466,799 B2 * 12/2008 Miller ..... H01J 35/16 378/121
7,476,023 B1 * 1/2009 Canfield ..... H05G 1/02 378/203
7,519,159 B2 * 4/2009 Radley ..... G01N 23/12 378/121
7,543,987 B2 * 6/2009 Canfield ..... A61B 6/40 378/141
7,664,229 B2 * 2/2010 Okada ..... H01J 35/08 378/121
7,668,297 B2 * 2/2010 Inazuru ..... H01J 35/18 378/121
7,720,199 B2 * 5/2010 Inazuru ..... H01J 35/025 378/119
7,734,015 B2 * 6/2010 Okada ..... H01J 35/08 378/122
7,773,726 B2 * 8/2010 Inazuru ..... H01J 35/08 378/119
7,831,020 B2 * 11/2010 Inazuru ..... H01J 35/04 378/136
8,867,706 B2 * 10/2014 Treseder ..... H01J 35/06 378/121
9,036,788 B2 * 5/2015 Ueda ..... H05G 1/025 250/522.1
9,070,529 B2 * 6/2015 Tamura ..... H01J 35/12
9,070,531 B2 * 6/2015 Ueda ..... H05G 1/025
9,076,627 B2 * 7/2015 Yanagisawa ..... H01J 35/16
9,263,226 B2 * 2/2016 Zhao ..... G01N 23/04

FOREIGN PATENT DOCUMENTS

CN 201229310 Y 4/2009
CN 102595754 A 7/2012
JP 2003-123999 A 4/2003

* cited by examiner

INSTALLATION CASE FOR RADIATION DEVICE, OIL-COOLING CIRCULATION SYSTEM AND X-RAY GENERATOR

CROSS-REFERENCE TO RELATED APPLICATION

This application is a National Stage Application of PCT/CN2012/088089, filed Dec. 31, 2012, which claims benefit of Chinese Patent Application No. 201210003988.8 filed on Jan. 6, 2012 in China and which applications are incorporated herein by reference. To the extent appropriate, a claim of priority is made to each of the above disclosed applications.

BACKGROUND OF THE INVENTION

1. Field of the Invention

The present disclosure belongs to the technical field of X-ray generator. In particular, the present disclosure relates to an installation case for a radiation device, an oil-cooling circulation system based on the installation case for a radiation device, and an X-ray generator with the oil-cooling circulation system.

2. Description of the Related Art

The kernel components of a safety inspection apparatus, which employs an X-ray imaging technique, are an X-ray source and an image capturing and processing system. Imaging quality and detection effect of the safety inspection apparatus, to a great extent, depend on performance of the X-ray source. Therefore, the quality of the X-ray source plays an important role. At present, an X-ray source of a safety inspection apparatus, which employs an X-ray imaging technique, mainly uses an X-ray generator.

The conventional X-ray generator comprises an X-ray tube assembly, a high frequency and high voltage generator, a filament power supplying module, a cooling system, and a case body. The X-ray tube assembly comprises an X-ray tube and a collimator (also referred to as a front collimator) fixedly connected with anode and cathode sheaths of the X-ray tube. The X-ray tube assembly is provided inside the case body. The case body is made by jointing sheet materials together using welding and bolts. The collimator and the case body are two separate components fixedly connected with each other. The collimator is provided with a beam exit aperture, and the case body is provided with a beam exit opening. The portion, except the beam exit opening, of the inner wall of the case body is fixedly provided with an X-ray shielding layer for shielding the X-ray in the non-main beam direction. The high frequency and high voltage generator is electrically connected with the anode and cathode of the X-ray tube to provide direct current voltage for the anode and cathode of the X-ray tube. The filament power-supplying module is electrically connected with the cathode of the X-ray tube to provide high frequency pulse voltage for the cathode of the X-ray tube. When the filament power-supplying module provides high frequency pulse voltage for the cathode of the X-ray tube, the cathode of the X-ray tube emits electron streams under the action of a high voltage electric field to bombard the anode of the X-ray tube, such that the X-ray is excited, and the X-ray can in turn pass through the beam exit aperture and the beam exit opening to the outside of the case body. The cooling system is used for dissipating the heat accumulated in the X-ray tube to avoid burning-out of the X-ray tube. The case body and the collimator form an enclosed space. This enclosed space is filled with a cooling liquid and is an important component part of the cooling system.

During operating of the X-ray generator, the main beam of the X-ray will pass through a beam exit channel constituted by the beam exit aperture and the beam exit opening to the outside of the case body, while the X-ray in the non-main beam direction will be shielded inside the shielding layer.

There are the following problems in the prior art.

The conventional case body is made by jointing sheet materials together using welding and bolts. However, there will be some gaps at corners and edges of the case body jointed through welding and bolts, due to welding deformation of material, insufficiently screwing-in of bolts, offsetting of screwing-in angle, or like. This causes the conventional case body to have a poor sealing, and the cooling liquid in the case body is likely to leak. Furthermore, the X-ray generated by the X-ray tube has great penetrating power. If the X-ray shielding layer is inappropriately provided, the case body will be weighty, or leakage of the X-ray will worsen, even beyond safety standard of X-ray leakage dose regulated by various industries.

SUMMARY OF THE INVENTION

Therefore, an object of the present disclosure is to provide an installation case for a radiation device, an oil-cooling circulation system based on the installation case for a radiation device, and an X-ray generator provided with the above oil-cooling circulation system, so that the technical problems of the weight of the case body of the conventional X-ray generator being heavy and leakage amount of the X-ray in the conventional X-ray generator being large can be solved.

In order to achieve the above object, the present disclosure provides the following solutions.

the installation case for a radiation device comprises a case body and a collimator fixedly connected with the case body, the collimator being provided with a beam exit aperture and the case body being provided with a beam exit opening; the installation case for a radiation device further comprises a layer or layers of shielding devices provided within the case body, the shielding device is made of a material that can shield a radioactive ray, and between the shielding device and the case body, there is a space in which liquid can flow and parts can be installed; the collimator and the shielding device are integrally formed, or the collimator and the shielding device are two separate parts and are fixedly connected with each other; each layer of the shielding device is provided with a ray exit aperture, and the ray exit aperture, the beam exit aperture and the beam exit opening are coaxial.

The above solution according to the present invention has the following advantages. Since the case body is provided therein with a layer or layers of shielding devices, the shielding device is made of a material that can shield the X-ray, the shielding device is provided in the case body and between the shielding device and the case body, there is a space in which liquid can flow and parts can be installed, when the X-ray tube is located in the shielding device, the X-ray emitted from the X-ray tube will orderly pass through the ray exit aperture, the beam exit aperture and the beam exit opening which are coaxial and be emitted out of the case body. Before the X-ray that is not emitted out of the case body from the beam exit opening provided in the case body reaches outside of the case body, it has to be subjected to at least double shielding of a layer or layers of shielding devices and the case body. Compared with the case body of the conventional installation case for a radiation device, the above structure of the installation case for a radiation device according to the present disclosure remarkably reduces the amount of the ray leaking out of the case body of the X-ray generator to the environment around the case body, so that the technical problem of amount of the ray leaking out of the case body to the environment around the case body being large can be solved. Meanwhile, the arrangement of the shielding device being provided in the case body enables the shielding device to be reasonably and effectively used, so that amount of shielding material can be reduced and hence the weight of the whole case body is reduced.

Preferable solutions of this disclosure are provided as follows.

Preferably, the radioactive ray is an X-ray; and/or the shielding device is made of insulation material;

and/or the shielding device is in a cylindrical or prismatic shape and comprises a cylindrical body, a first end cover and a second end cover, wherein the first end cover and the second end cover are fixedly connected with the two end openings of the cylindrical body, respectively, and at least one of the first end cover, the second end cover and the cylindrical body are provided with a fluid channel and/or a circuit channel;

and/or the case body is provided therein with multiple layers of shielding device of which the inner layer of shielding device is located inwardly of the outer layer of shielding device, and between the inner layer of shielding device and the outer layer of shielding device and between the case body and the outermost layer of shielding device, there are spaces for flowing of liquid and mounting of parts.

Preferably, the circuit channel and/or the fluid channel is a through hole in a bent shape or an oblique hole provided in at least one of the first end cover, the second end cover and the cylindrical body; or at least one of the first end cover, the second end cover and the cylindrical body is in a dual-layer structure that is formed by superimposing an outer plate and an inner plate, and wherein a liquid flowing cavity is provided between the outer plate and the inner plate, and both of the outer plate and the inner plate are provided with a flow guiding orifice communicating with the liquid flowing cavity, and the fluid channel is constituted by the flow guiding orifices and the liquid flowing cavity, and the orthographic projection of the flow guiding orifice in the outer plate in the axial direction thereof and the flow guiding orifice provided in the inner plate are entirely staggered.

Preferably, the bent shape is a right-angle polygonal-line shape;

and/or both of the first and second end covers are provided with the fluid channels and the circuit channels;

and/or a plurality of flow guiding orifices are distributed on the outer plate and/or the inner plate of the first end cover and/or the second end cover along the circumferential direction of the cylindrical body at equal angle intervals, and the distances between the respective flow guiding orifices and the axis of the cylindrical body are equal with each other;

and/or the cylindrical body is provided with inner screw threaded tubes embedded therein, and the inner screw threaded tubes each are provided with inner screw thread, and the portion of a connection bolt having outer screw thread passes through the outer plate and engages with the inner screw thread of the inner screw threaded tube;

and/or the inner plate is fixedly provided with a positioning pole which is embedded into a positioning counter bore in the outer plate and is tightly fitted with the positioning counter bore;

and/or a step portion in a step shape is provided at the inside end edge of the cylindrical body, and the step portion bears against the edge of the inner plate.

Preferably, the shielding device is made of lead oxide;

and/or the beam exit opening is filled with a blocking window, and the blocking window is made of a material through which the radioactive ray can transmit, and the blocking window functions to realize liquid and gas seal between the inside of the case body and the outside of the case body;

and/or the case body comprises a main body portion, a first case cover and a second case cover, wherein:

the first case cover and the second case cover are fixedly provided at the two end openings of the main body portion, respectively, the main body portion is integrally formed, and the material for the first case cover and the second case cover is the same as that for the main body portion.

Preferably, the shielding device is made of trilead tetroxide;

and/or the main body portion is made of aluminum or aluminum alloy material and is formed by using a stretch forming process or a wire electrode cutting process;

and/or sealing strips are provided between the first case cover and the main body portion and/or between the second case cover and the main body portion, wherein: the end face of the main body portion is provided with a step face or a groove, and the sealing strip is provided on the step face or provided in the groove and extends beyond the end face of the main body portion, and the first case cover and/or the second case cover are close to the surface of the main body portion and press against the portions of the sealing strips extending beyond the end face of the main body portion, or a step face or groove is provided on an edge of the first case cover and/or the second case cover, the sealing strip is provided on the step face or provided in the groove and extends beyond the edge of the first case cover and/or the second case cover, and the main body portion is close to the surface of the first case cover and/or the second case cover and presses against the portions of the sealing strips extending beyond the edge of the first case cover and/or the second case cover.

The oil-cooling circulation system according to this disclosure comprises a liquid-filled box, an insulation liquid filled in the liquid-filled box and a cooling device for reducing the temperature of the insulation liquid, and the cooling device comprises an oil pump, a heat radiator and a cooling fan, wherein:

the liquid-filled box is constituted by the installation case for a radiation device according to any one of the foregoing technical schemes;

the heat radiator is located outside of the liquid-filled box, a liquid inlet of the heat radiator is communicated with a liquid outlet of the liquid-filled box, and a liquid outlet of the heat radiator is communicated with a liquid inlet of the liquid-filled box;

the oil pump provides a motive power for circulation between the insulation liquid in the liquid-filled box and the insulation liquid in the heat radiator;

the cooling fan dissipates the heat from the heat radiator in such a way that the flow of ambient air around the heat radiator is expedited.

Preferably, the cooling device further comprises a frame-shaped bracket hooding the heat radiator and the cooling fan, and the bracket is fixedly connected with the liquid-filled box;

and/or the oil pump is a DC brushless submersible pump;

and/or the oil pump is fixedly provided on the inner wall of the liquid-filled box and is located between the liquid-filled box and the shielding device, or the oil pump is fixedly provided in the heat radiator;

and/or the shielding device is provided with a fluid channel, wherein:

a liquid outlet and a liquid inlet of the shielding device are located in the fluid channel;

a liquid suction port of the oil pump faces toward the liquid outlet of the shielding device, or the liquid suction port of the oil pump is communicated with the liquid outlet of the shielding device via a conduit;

the liquid inlet of the shielding device is communicated with a liquid inputting pipe, the liquid outlet of the liquid-filled box is communicated with a liquid introducing pipe, and a liquid outputting port of the liquid introducing pipe faces toward a liquid inputting port of the liquid inputting pipe, or the liquid inlet of the shielding device is communicated with the liquid outlet of the liquid-filled box via a conduit.

The X-ray generator according to the present disclosure comprises an X-ray tube, a high frequency and high voltage generator, a filament power supplying module and the oil-cooling circulation system according to the present disclosure, wherein:

the X-ray tube is mounted within the shielding device, and the X-ray emitted from the X-ray tube passes through the ray exit aperture, the beam exit aperture and the beam exit opening in this order and radiates out of the case body of the installation case for a radiation device;

the high frequency and high voltage generator is electrically connected with a cathode and an anode of the X-ray tube;

the filament power supplying module is electrically connected with the cathode of the X-ray tube.

Preferably, the shielding device is further provided with a circuit channel, the high frequency and high voltage generator is electrically connected with the cathode and anode of the X-ray tube via wires or interfaces passing through the circuit channel, and the filament power supplying module is electrically connected with the cathode of the X-ray tube via wires or interfaces passing through the circuit channel;

at least some of modules constituting the high frequency and high voltage generator are located between the case body and the shielding device, and a power supply external to the case body and the rest of the modules constituting the high frequency and high voltage generator are located outside of the case body;

the case body is provided with a wire exit channel, and those of the modules constituting the high frequency and high voltage generator located in the case body are electrically connected with those modules located outside of the case body via wires or interfaces passing through the wire exit channel, or the high frequency and high voltage generator is electrically connected with the external power supply via wires or interfaces passing through the wire exit channel;

the shielding device comprises a cylindrical body, a first end cover and a second end cover, and the first end cover and the second end cover are fixedly connected with two end openings of the cylindrical body, respectively;

at least one of the first end cover, the second end cover and the cylindrical body is provided with a fluid channel and the circuit channel.

Preferably, both of the first end cover and the second end cover are a dual-layer structure constituted by laminating an outer plate and an inner plate, and both of the first end cover and the second end cover are provided with the circuit channel, wherein:

the circuit channel provided in the first end cover comprises a cathode positioning aperture provided in the inner plate of the first end cover and a wire routing aperture provided in the outer plate of the second end cover, and in the X-ray tube, a sheath for protecting the cathode is embedded in the cathode positioning hole, and the wire routing aperture comprises a longitudinal aperture coincident with/parallel to the axial direction of the X-ray tube and a transverse aperture communicating with the longitudinal aperture, the axial direction of the transverse aperture being perpendicular to the axial direction of the longitudinal aperture, and the cathode of the X-ray tube is led out from the wire routing aperture from an inside of the sheath by two wires;

the circuit channel provided in the second end cover comprises anode positioning apertures provided in the inner plate and the outer plate of the second end cover, a conductive stud orderly passes through the anode positioning apertures provided in the outer plate and the inner plate of the second end cover, and the conductive stud is provided with an outer screw threaded portion which is engaged with an anode screw hole provided in the anode, the portion of the conductive stud far away from the anode is provided with a positioning screw hole, a conductive screw is provided with an outer screw threaded portion which is engaged with the positioning screw hole, and a wire electrically connected with the anode of the high frequency and high voltage generator is sandwiched between a head of the conductive screw and the conductive stud;

and/or the inner plate of the second end cover is provided with at least one anode position-limit hole, the anode is provided with a position-limit screw hole, a positioning stud is provided with an outer screw threaded portion which is engaged with the position-limit screw hole, and the end of the positioning stud far away from the position-limit screw hole is inserted in the anode position-limit hole;

and/or both of the first end cover and the second end cover are provided with the fluid channels, both of the first end cover and the second end cover are the dual-layer structure constituted by the laminated outer plate and inner plate, there is a liquid flowing cavity between the outer plate and the inner plate, and both of the inner plate and the outer plate are provided with flow guiding orifices communicated with the liquid flowing cavity, and the fluid channel is constituted by the flow guiding orifices and the liquid flowing cavity;

the anode is in a hood shape and covers the end of a glass hood of the X-ray tube far away from the cathode, a liquid flowing space is provided between the anode and the outer circumferential surface of the glass hood of the X-ray tube, and the anode is provided with liquid circulating holes respectively communicating with the liquid flowing space and the flow guiding orifice provided in the inner plate of the second end cover.

Preferably, the bent shape is a right-angle polygonal-line shape;

and/or the case body comprises a main body portion, a first case cover and a second case cover, wherein:

the first case cover and the second case cover are fixedly provided at the two end openings of the main body portion, respectively;

constituent modules of the high frequency and high voltage generator comprise a first rectification and voltage regulation module, a high frequency inverter, a high voltage transformer and a voltage-doubling rectification module which are electrically connected with each other in this order, wherein:

the first rectification and voltage regulation module is electrically connected with the external power supply and is configured to take electrical energy required for loading a DC high voltage to the cathode and the anode of the X-ray tube from the external power supply;

the voltage-doubling rectification module is electrically connected with the cathode and the anode of the X-ray tube;

among the constituent modules of the high frequency and high voltage generator, at least the high voltage transformer and the voltage-doubling rectification module are fixedly provided between the case body and the shielding device;

the high voltage transformer is fixedly provided on the collimator, the first case cover, the second case cover or the shielding device, and the voltage-doubling rectification module is fixedly provided on a circuit board, wherein:

at least one of two ends of the circuit board bears against a position-limit protruding piece fixedly provided on the first case cover or the second case cover, and the circuit board is fixed on the position-limit protruding pieces by fasteners, or at least one of the two ends of the circuit board is inserted in a groove provided on the first case cover or the second case cover, and the middle region of the circuit board is fixed on the main body portion by fasteners.

Preferably, the X-ray generator further comprises a monitor system, and the monitor system comprises a signal sampling module, a sampled-signal processing module, a logic decision and control module, and an auxiliary power supply module configured to supply power for the logic decision and control module, wherein:

the signal sampling module is located between the case body and the shielding device or is located within the shielding device;

the signal sampling module is used for detecting electric signals on the cathode and/or the anode of the X-ray tube, the temperature of the insulation liquid and the flow rate of the insulation liquid flowing into or flowing out of the case body, and sends the detected electric signals to the sampled-signal processing module;

the sampled-signal processing module is electrically connected with the signal sampling module and the logic decision and control module;

the sampled-signal processing module is configured for processing the electric signals such as filtering the electric signals and/or converting the electric signals into the detection result in a digital form through analog-digital conversion and sending the detection result in a digital form to the logic decision and control module;

the logic decision and control module is also electrically connected with at least one of the high frequency and high voltage generator, the filament power supply module, and the cooling device;

the logic decision and control module automatically calls previously-stored control instructions according to the detection result based on predetermined correspondence rules between the detection result and the control instructions, and controls at least the output voltage and/or current of the high frequency and high voltage generator or the filament power supply module according to the control instructions, or controls power consumption of the cooling device according to the control instructions.

Preferably, the filament power supply module comprises a second rectification and voltage regulation module electrically connected with the logic decision and control module, a filament inverter and a filament transformer electrically connected with the filament inverter and the cathode of the X-ray tube;

the filament transformer is fixedly provided in the case body, and is configured to convert the voltage output from the filament inverter into a high frequency pulse voltage required for the cathode of the X-ray tube and to output the high frequency pulse voltage to the cathode of the X-ray tube;

the first rectification and voltage regulation module, the high frequency inverter, the logic decision and control module, the second rectification and voltage regulation module, the filament inverter and the auxiliary power supply module are fixedly provided on the outer surface of the case body or in a control box provided outside of the case body;

the wires or interfaces passing through the wire exit channel provided in the case body are aviation plugs that provide liquid and gas seal between the inside of the case body and the outside of the case body, wherein the high voltage transformer and the high frequency inverter are electrically connected with each other via the aviation plugs, the signal sampling module and the sampled-signal processing module are electrically connected with each other via the aviation plugs and/or the filament inverter and the filament transformer are electrically connected with each other via the aviation plugs.

The above respective preferable technical solutions can also achieve the following technical effects.

Since the main body portion in the embodiments is formed by using a stretch forming process or a wire electrode cutting process causing a small deformation, and arrangement of sealing strips improves sealing of the case body, leakage of the insulation liquid from the case body can be reduced. Since a layer or layers of shielding devices provided in the case body according to the embodiments are made of light material and have a small volume, the technical problem of the weight of the case body being heavy is overcome. Further, since the end covers of the shielding device are in a double-layer structure in which the two layers are superimposed with each other, requirements for liquid flowing in the cooling system can be met and good X-ray shielding can be ensured.

BRIEF DESCRIPTION OF THE DRAWINGS

The accompanying drawings described herein, which forms a part of the present application, is intended to provide a further understanding of the present disclosure. The exemplary embodiments of the present disclosure and the description thereof are intended to explain the present disclosure and are not intended to limit the present disclosure in an inappropriate way. In the drawings.

DETAILED DESCRIPTION OF THE EMBODIMENTS

Next, the technical scheme of the present disclosure will be described in details with reference to the accompanying drawings and embodiments.

The embodiments of the present disclosure provide an installation case for a radiation device, an oil-cooling circulation system based on the installation case for a radiation device, and an X-ray generator provided with the oil-cooling circulation system. The installation case can effectively avoid leakage of an X-ray, emitted from an X-ray tube, out of the case body to surroundings of the case body. In addition, the installation case is light in weight and occupies small space.

Figure 1:
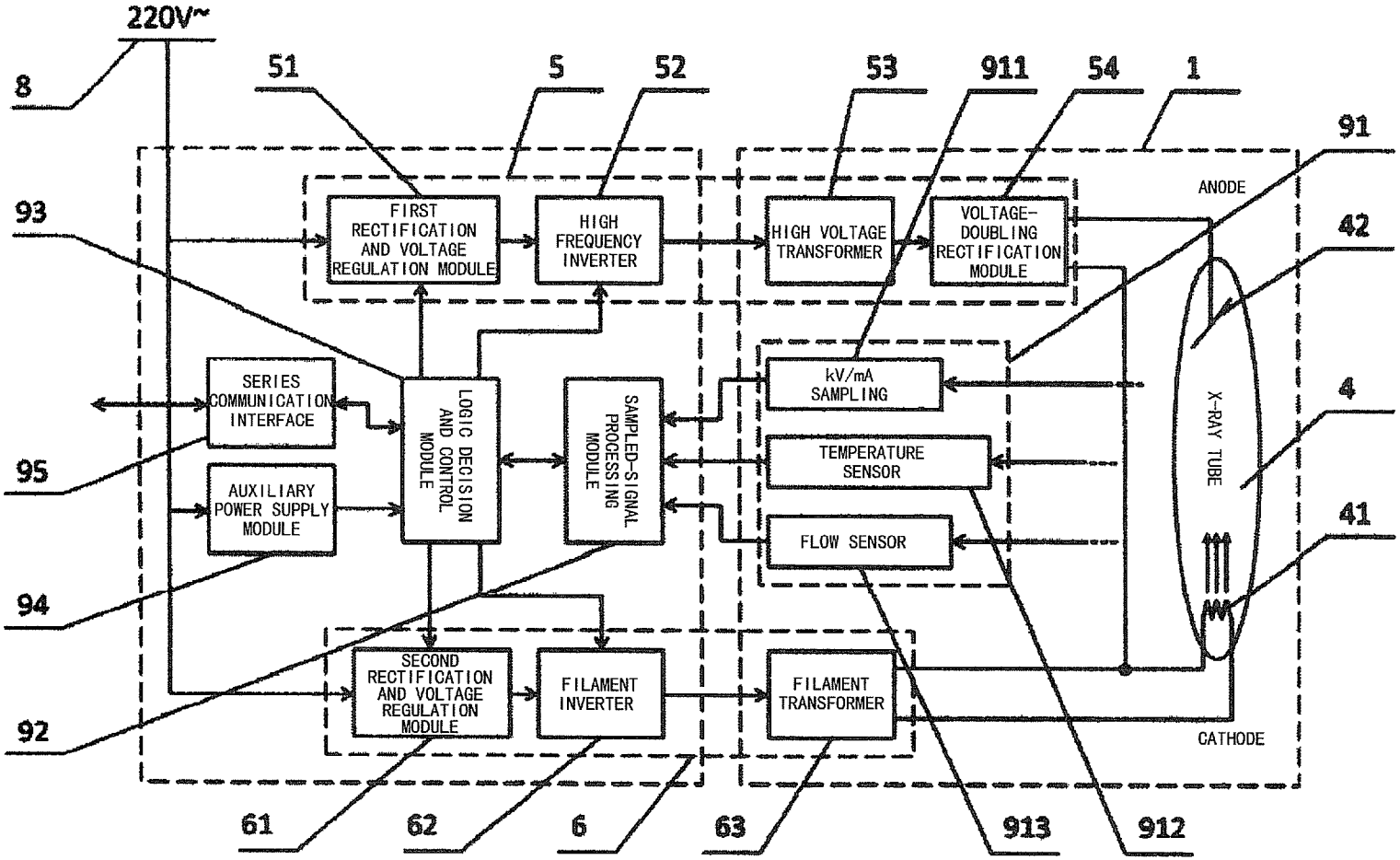
FIG. 1 is a schematic view of connection relationship between respective electronic elements in an X-ray generator according to an embodiment of the present disclosure.
Figure 2:
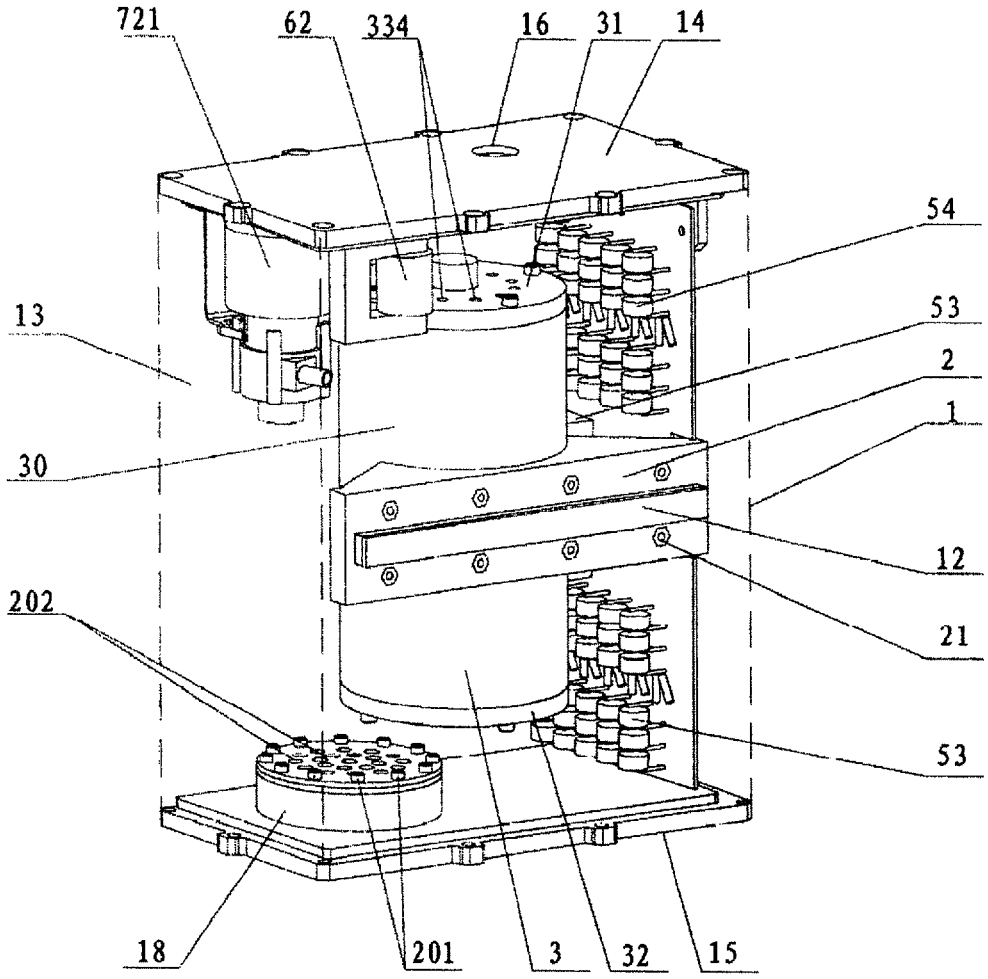
FIG. 2 is a perspective schematic view showing, in part, components of a spatial structure of an installation case for a radiation device according to an embodiment of the present disclosure.
Figure 3:
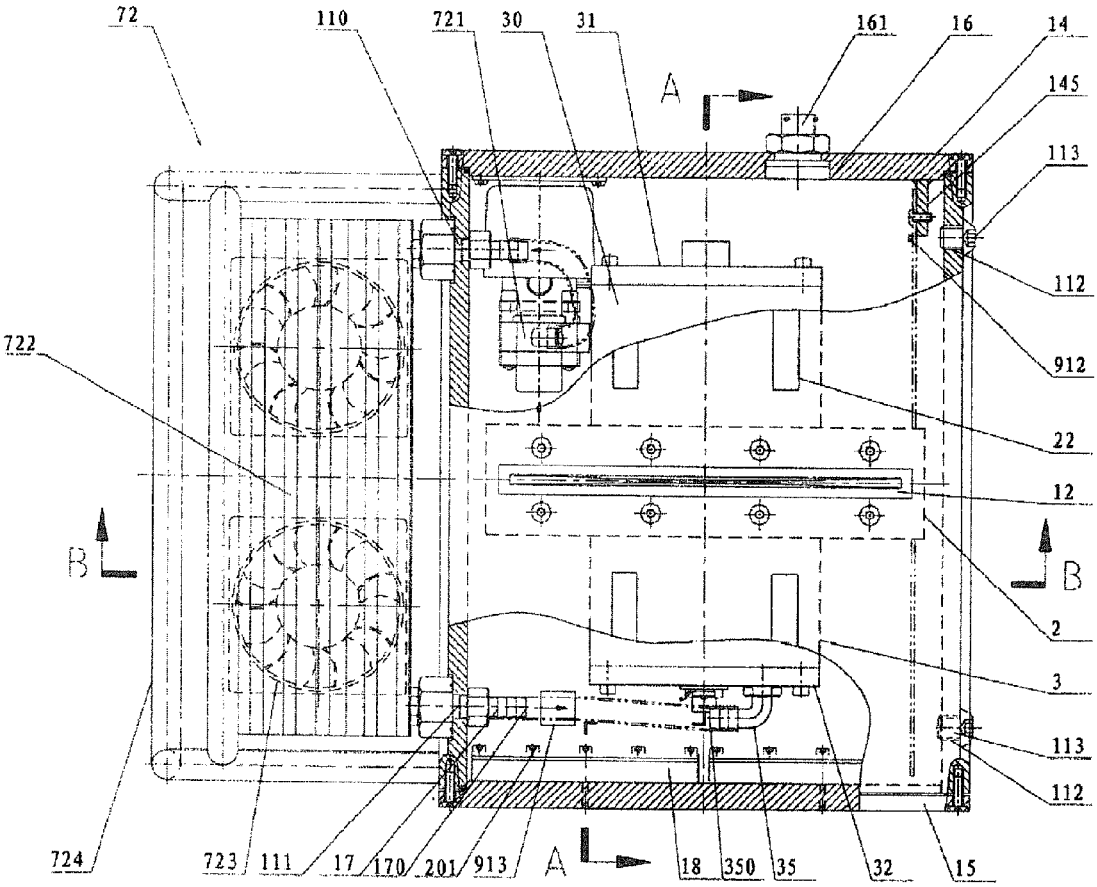
FIG. 3 is a schematic partial view, in cross section, of the X-ray generator according to an embodiment of the present disclosure.

As shown in FIGS. 1-3, the installation case for a radiation device proposed by the embodiments of the present disclosure comprises a case body 1, a collimator 2 as shown in FIG. 2, and a layer of shielding device 3 provided inside the case body 1.

Figure 5:
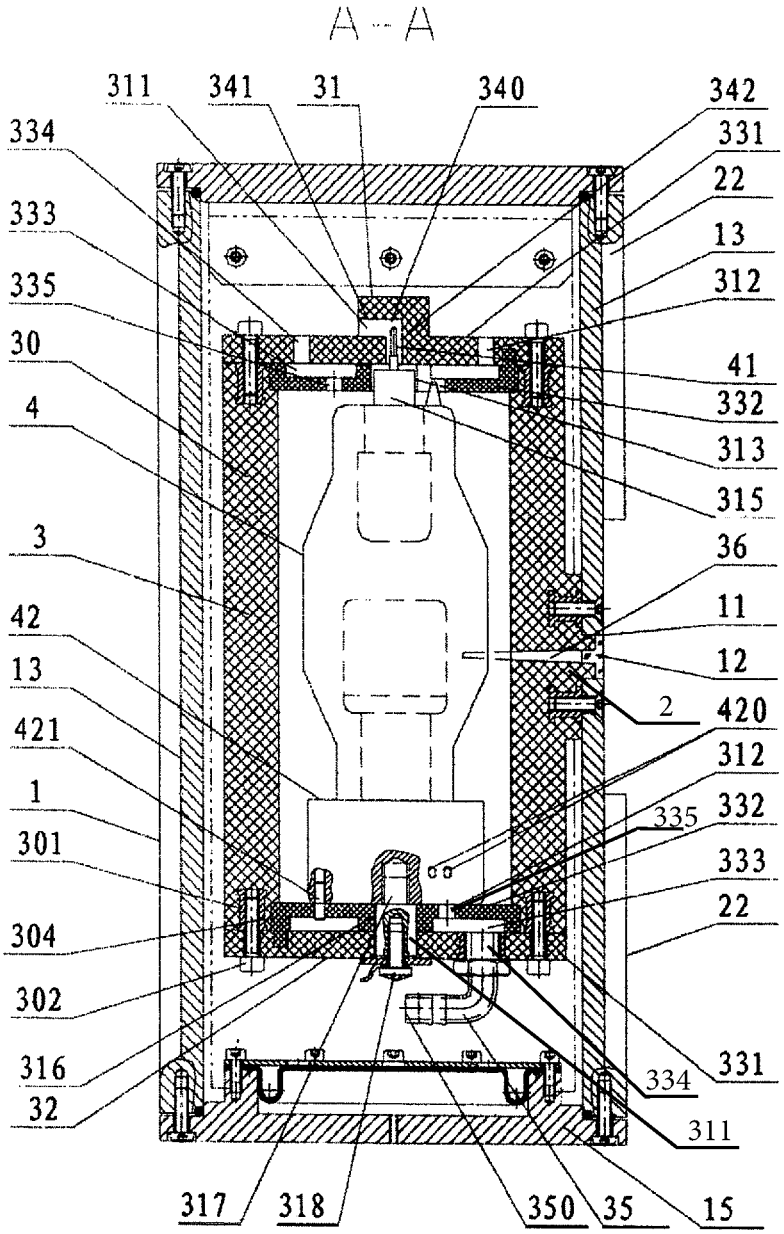
FIG. 5 is a schematic view, in cross section, taken along an A-A line of FIG. 3.

The shielding device 3 is made of material that can shield an X-rays. Between the shielding device 3 and the case body 1, there is a space in which liquid can flow and parts can be installed. The collimator 2 and the shielding device 3 are integrally formed. The collimator 2 and the case body 1 are two separate parts and they are detachably and fixedly connected with each other. The shielding device 3 is provided with a ray exit aperture 36 as shown in FIG. 5, the collimator 2 is provided with a beam exit aperture (coinciding with the ray exit aperture 36 shown in FIG. 5), and the case body 1 is provided with a beam exit opening 11. The ray exit aperture 36, the beam exit aperture and the beam exit opening 11 are coaxial.

The case body 1 according to the embodiment of the present disclosure is provided therein with a layer of shielding device 3. It is appreciated that multiple layers of shielding device 3 can be provided. The shielding device 3 is made of material, e.g., lead oxide, that can shield the X-rays. The shielding device 3 is located inside the case body 1. When the X-ray tube 4 shown in FIG. 5 is provided inside the shielding device 3, the X-rays emitted by the X-ray tube 4 passes through the ray exit aperture 36, the beam exit aperture and the beam exit opening 11 shown in FIG. 5, which are coaxial, to outside the case body 1 in this order.

In this embodiment, the ray exit aperture 36, the beam exit aperture and the beam exit opening 11 being coaxial may mean that they are entirely coaxial, that is, their orthographic projections in the respective axial directions are entirely coincident, or that they are partially coaxial, that is, their orthographic projections in the respective axial directions are partially coincident, as long as the X-rays can in turn pass through the ray exit aperture 36, the beam exit aperture and the beam exit opening 11 to outside the case body 1 finally.

In this embodiment, between the shielding device 3 and the case body 1, there is a space in which liquid can flow and parts can be installed, as shown in FIG. 2. The size of the space may be appropriately arranged according to requirements. On one hand, the presence of the space for flowing of liquid and mounting of components allows electric elements to be mounted and insulation liquid to be filled, in which the insulation liquid is used for enhancing insulation properties and heat dispersion between the electric elements; but on the other hand, the shielding device 3 can be made in a smaller size, without adversely affecting heat dispersion and shielding effect, so that the material for the case body can be saved and the volume and weight of the case body can be reduced.

When the X-ray tube 4 shown in FIG. 5 is mounted in the shielding device 3 provided in the case body 1, the thickness of the shielding device 3 and the number of the layer of shielding device 3 can be determined according to the intensity of the X-rays emitted from the X-ray tube 4.

When multiple layers of shielding device 3 are provided in the case body 1, each layer of shielding device 3 may be made of the material that can shield the X-ray, or some layers of the multiple layers of shielding device 3 may be made of the material that can shield the X-rays. Every layer of shielding device 3 is located in the case body 1. The inner layer of shielding device 3 is located inwardly of the outer layer of shielding device 3. The space for flowing of liquid and mounting of components is between the case body 1 and the outermost layer of shielding device 3. The X-ray tube 4 is mounted inwardly of the innermost layer of shielding device 3.

Further, in this embodiment, the collimator 2 and the case body 1 may be integrally formed. In this case, the collimator 2 and the shielding device 3 are two separate parts and are detachably and fixedly connected with each other, e.g., by screws or bolts. However, in a case where manufacture accuracy is high, the collimator 2, the case body 1 and the shielding device 3 or the bodies thereof may be integrally formed.

As shown in FIGS. 2, 3, 5 and 9, in this embodiment, the shielding device 3 is in a cylindrical shape and comprises a cylindrical body 30, a first end cover 31 and a second end cover 32. The first end cover 31 and the second end cover 32 are fixedly connected to the two end openings of the cylindrical body 30, respectively. Both of the first end cover 31 and the second end cover 32 are provided with a fluid channel 312 and a circuit channel 311, as shown in FIG. 5.

With the above simple structure, the assembly of the shielding device 3 is facilitated and the manufacture of the respective parts of the shielding device 3 is facilitated. Furthermore, the smooth flowing of the insulation liquid and the connection of wires and interfaces are facilitated. Since the smooth flowing of the insulation liquid is facilitated, the heat of the X-ray tube 4 mounted in the shielding device 3 can be easily dispersed, so that the efficiency of cooling the X-ray tube 4 is enhanced. Alternatively, instead of in a cylindrical shape, the shielding device 3 may be in a prismatic shape (including rectangular parallelepiped and square parallelepiped), in a circular stage shape, or the like.

In this embodiment, as shown in FIG. 5, one or both of the circuit channel 311 and the fluid channel 312 may only be provided in the cylindrical body 30. Alternatively, the circuit channel 311 and the fluid channel 312 may be formed in the cylindrical body 30 and the first end cover 31 or second end cover 32, respectively.

As shown in FIG. 5, in this embodiment, both of the first end cover 31 and the second end cover 32 are in a dual-layer structure that is formed by superimposing an outer plate 331 and an inner plate 332.

A liquid flowing cavity 333 is provided between the outer plate 331 and the inner plate 332. The outer plate 331 is provided with flow guiding orifices 334 communicating with the liquid flowing cavity 333. The inner plate 332 is provided with flow guiding orifices 335 communicating with the liquid flowing cavity 333. The fluid channel 312 is constituted by the flow guiding orifices 334, the flow guiding orifices 335 and the liquid flowing cavity 333. The orthographic projection of the flow guiding orifices 334 in the outer plate 331 in the axial direction thereof and the flow guiding orifices 335 provided in the inner plate 332 are entirely staggered.

In this embodiment, the circuit channel 311 provided in the first end cover 31 comprises a cathode positioning aperture 313 provided in the inner plate 332 of the first end cover 31 and a wire routing aperture 340 provided in the outer plate 331 of the first end cover 32. The wire routing aperture 340 is a bent through hole. The wire routing aperture 340 preferably comprises a longitudinal aperture 342 coincident with/parallel to the axial direction of the shielding device 3 and a transverse aperture 341 communicating with the longitudinal aperture 342. The axial direction of the transverse aperture 341 is perpendicular to the axial direction of the longitudinal aperture 342.

When the case body 1 is filled with the insulation liquid, the first end cover 31 and the second end cover 32 in the above structure can ensure that the insulation liquid can not only flow into the cylindrical body 30 via the fluid channel 312 in the second end cover 32, but can also flow out of the shielding device 3 via the fluid channel 312 the first end cover 31. What is more important is that:

When the X-ray tube 4 is mounted in the shielding device 3, the orthographic projections of the flow guiding orifices 334 in the outer plate 331 in the axial direction thereof and the flow guiding orifices 335 in the inner plate 332 are entirely staggered. The fluid channel 312 forms a labyrinth structure. In this way, even if the X-rays emitted from the X-ray tube 4 passes through the flow guiding orifices 335 in the inner plate 332, the X-rays will not pass through the flow guiding orifice 334 in the outer plate 331, and hence will not pass through the shielding device 3. Similarly, the circuit channel 311 in the above structure also forms a labyrinth structure, and the circuit channel 311 can efficiently prevent the X-rays from straightly passing through the shielding device 3 without adversely affecting connection of interfaces and wires.

In the present disclosure, in a case where the first end cover 31 and the second end cover 32 are not provided in a dual-layer structure, the circuit channel 311 and/or the fluid channel 312 may also form the above labyrinth structure. In this case, the circuit channel 311 and/or the fluid channel 312 may be through holes in a bent shape, such as a right-angle polygonal-line shape, or may be an oblique hole (such as a through hole, the axial direction of which is at an acute or obtuse angle to the axial direction of the shielding device 3, preferably at an acute angle with a smaller angle value or an obtuse angle with a larger angle value to the axial direction of the shielding device 3).

Further, one of the flow guiding orifice 334 in the outer plate 331 and the flow guiding orifice 335 in the inner plate 332 and/or one of the wire routing aperture 340 in the outer plate 331 and the cathode positioning aperture 313 in the inner plate 332 may be a through hole in a bent shape (e.g., a right-angle polygonal-line shape) or an oblique hole. In this case, the first end cover 31 and the second end cover 32 also can form the circuit channel 311 and/or the fluid channel 312 in a labyrinth structure. Since the orthographic projections of the two end openings of the oblique hole in the radial direction of the shielding device 3 are entirely or partially staggered, the oblique hole can also partially or entirely prevent the X-rays irradiating one of the two end openings of the oblique hole from passing through the other of the two end openings while leading out the wires or allowing the insulation liquid to flow therethrough, especially in a case where the ratio of the thickness of the shielding device 3, the first end cover 31 and the second end cover 32 to the size of the end openings of the circuit channel 311 and/or the fluid channel 312 is great.

Figure 6:
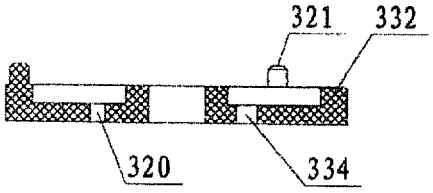
FIG. 6 is a schematic view, in cross-section, of an inner plate of a second end cover of FIG. 5.
Figure 7:
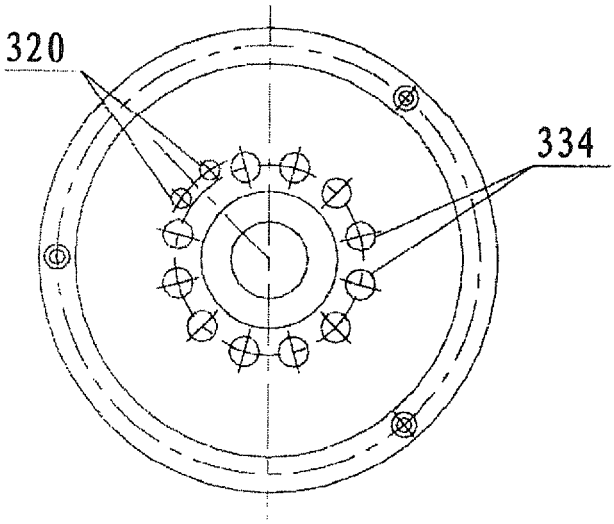
FIG. 7 is a top schematic view of the inner plate of the second end cover of FIG. 6.

As shown in FIG. 5, in this embodiment, a plurality of (more than two) flow guiding orifices 335 are distributed in the inner plate 332 (as shown in FIGS. 6 and 7) of the first end cover 31 along the circumferential direction of the cylindrical body 30 shown in FIG. 5 at equal angle intervals, and the distances between the respective flow guiding orifices 335 and the axis of the cylindrical body 30 (the axis of the cylindrical body 30 is also the axis of the shielding device 3) are equal with each other.

Further, the outer plate 331 of the first end cover 31 also can be provided with a plurality of (more than two) flow guiding orifices 334 along the circumferential direction of the cylindrical body 30 at equal angle intervals. The flow guiding orifices 335 may be distributed in the first end cover 31 in other distribution manners. Also, the flow guiding orifices 334 in the first end cover 31 can be distributed in the above-described manner. Further, the flow guiding orifices 334 or the flow guiding orifices 335 may be distributed only in the outer plate 331 or the inner plate 332 of the first end cover 31 in the above described manner.

In this embodiment, the wire routing aperture 340 in the outer plate 331 of the first end cover 31 comprises a longitudinal aperture 342 coincident with the axial direction of the cylindrical body 30 (the axial direction of the cylindrical body 30 is also the axial direction of the shielding device 3) and a transverse aperture 341 communicating with the longitudinal aperture 342 and the axial direction of which is perpendicular to the axial direction of the longitudinal aperture 342.

The transverse aperture 341 and the longitudinal aperture 342 form the wire routing aperture 340 in a shape of right-angle polyline. Such structure can ensure that the X-ray emitted from the X-ray tube 4 does not come out of the wire routing aperture 340 while the wire electrically connected with a cathode 41 of the X-ray tube 4 (which can be regarded as a part of the cathode) is led out from the wire routing aperture 340. In an embodiment, the longitudinal aperture 342 may be parallel to the axial direction of the cylindrical body 30, and the wire routing aperture 340 may be an oblique through hole or a through hole in other bent shapes, such as a sharp-angle polyline shape or an obtuse-angle polyline shape.

In the X-ray tube 4, a sheath 315 for protecting the cathode 41 is embedded in the cathode positioning hole 313 of the inner plate 332 of the first end cover 31, and the wire sheath 315 (usually made of copper material) electrically connected with the cathode 41 is led out from the shielding device 3. An inner anode (or anode base) 42 of the X-ray tube 4 is fixed to the second end cover 32 by using fasteners made of conductive material (in this embodiment, the fasteners are a conductive stud 317 and a conductive screw 318 shown in FIG. 5), and the anode 42 of the X-ray tube 4 is electrically connected with an anode of an voltage-doubling rectification module 54 (the anode of the voltage-doubling rectification module 54 is also the anode of a high frequency and high voltage generator 5 shown in FIG. 1) provided outside the shielding device 3 by using fasteners and wires electrically connected with the fasteners. The fasteners made of conductive material themselves also provide conducting function.

The anode 42 of the X-ray tube 4 is in a shape of hood and is hooded on an end of a glass hood of the X-ray tube 4 far away from the cathode 41, and a liquid flowing space 422 is provided between the anode 42 and the outer circumferential surface of the glass hood of the X-ray tube 4, and the anode 42 is provided with liquid circulating holes 423 communicating with the liquid flowing space 422. In this structure, the insulation liquid outside the shielding device 3 flows into/flows out of the shielding device 3 through the liquid circulating holes 423 shown in FIG. 12 or 13. In this embodiment, the axial direction of the liquid circulating holes 423 is preferably parallel to the axial direction of the X-ray tube 4.

In order to position the anode 42 more effectively, the outer circumferential surface of the anode 42 may also be provided with one, two or plural circumferential screw holes 420. The screws passing through the cylindrical body 30 and embedded in the circumferential screw holes 420 fix the anode 42 in the shielding device 3 in the circumferential direction of the anode 42.

The above structure can be mounted easily and conveniently and can also provide reliable connection.

Preferably, the number of the flow guiding orifices 335 distributed in the inner plate 332 of the second end cover 32 is the same as that of the liquid circulating holes 423 of the anode 42 of the X-ray tube 4. In an embodiment, the number of the flow guiding orifices 335 is different from that of the liquid circulating holes 423. The advantage of the above structure is that the insulation liquid with a lower temperature can first flow to the vicinity of the inner anode 42 of the X-ray tube 4, so that a target embedded onto the anode 42 of the X-ray tube 4 can be prevented from burning out due to a too high temperature.

In this embodiment, the shielding device 3 is made of material having protection and insulation properties. When the X-ray tube 4 is mounted within the shielding device 3, the above structure not only can effectively avoid leakage of the X-ray, but also can prevent the X-ray tube 4 loaded with high voltage and electric elements or modules for supplying the high voltage to the X-ray tube 4 (e.g., as shown in FIG. 1, a high voltage transformer 53 and the voltage-doubling rectification module 54 in the high frequency and high voltage generator 5) from suffering electric arc or short circuit within the case body 1.

In this embodiment, the cylindrical body 30 is provided with inner screw threaded tubes 301 embedded therein. The inner screw threaded tubes 301 each is provided with inner screw thread, and the portion of a connection bolt 302 having outer screw thread passes through the outer plate 331 and engages with the inner screw thread of the inner screw threaded tube 301, so that the cylindrical body 30 and the first and second end covers 31 and 32 are connected and fixed together.

The screw thread connection structure constituted by the connection bolts 302 and the inner screw threaded tubes 301 connects the cylindrical body 30 with the first and second end covers 31 and 32 and fix them together.

Since the cylindrical body 30 is made of lead oxide and therefore is very fragile, it is very difficult to form inner screw thread in the cylindrical body 30 by cutting processing. Preferably, the embedded inner screw threaded tube 301 is made of high temperature-resistant metal material. The inner screw threaded tube 301 can be embedded into the cylindrical body 30 before the cylindrical body 30 is not completely formed.

In this embodiment, as shown in FIG. 6, the inner plate 332 is fixedly provided with a positioning pole 321 which is embedded in a positioning counter bore (not shown) in the outer plate 331 and is tightly fitted with the positioning counter bore. Preferably, the positioning pole 321 is integrally formed with the inner plate 332.

In this embodiment, a step portion 304 in a step shape is provided at the inside end edge of the cylindrical body 30, and the step portion 304 bears against the edge of the inner plate 332. With the above structure, easiness of installation and assembly and compact structure can be achieved.

Figure 10:
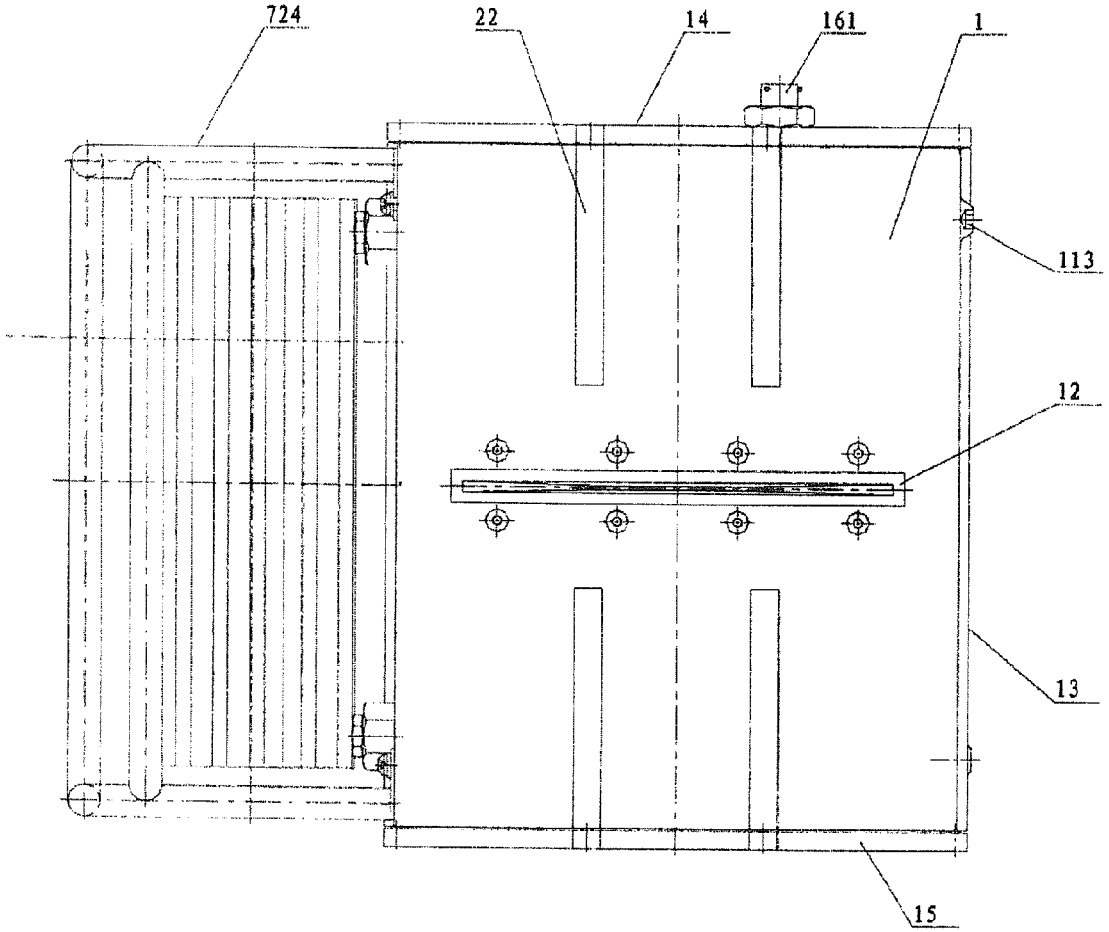
FIG. 10 is a schematic elevation view of the installation case for a radiation device according to an embodiment of the present disclosure.

As shown in FIG. 5, in this embodiment, the beam exit opening 11 is filled with a blocking window 12 shown in FIG. 3 or FIG. 10. The blocking window 12 is made of a material through which the X-ray can transmit, and the blocking window 12 has a function of realizing liquid and gas seal between the inside of the case body 1 and the outside of the case body 1.

The blocking window 12 seals the beam exit opening 11. On one hand, environment air and dust can be prevented from entering into the case body 1, and on the other hand, when the inside of the shielding device 3 and/or the space for flowing of liquid and mounting of components between the shielding device 3 and the case body 1 is filled with the insulation liquid, the blocking window 12 also can prevent the insulation liquid from flowing out of the case body 1 from the beam exit opening 11. When the inside of the shielding device 3 is filled with the insulation liquid, the X-ray emitted from the X-ray tube 4 will penetrate the insulation liquid and radiate the environment outside of the case body 1 from the blocking window 12. Since the X-ray emitted from the X-ray tub 4 has a high intensity, loss of the X-ray caused by the insulation liquid is slight and usually can be omitted.

It should be noted that, in this embodiment, there is a possibility that no blocking window 12 is provided. When the glass hood of the X-ray tube 4 shown in FIG. 5 tightly bears against the end opening of the ray exit aperture 36 at the inside of the shielding device 3, and the ray exit aperture 36, the beam exit aperture (coincident with the ray exit aperture 36), the beam exit opening 11 and the glass hood of the X-ray tube 4 constitute an insulation liquid sealing chamber, the insulation liquid cannot leak from a gap between the X-ray tube 4 and the shielding device 3 to the ray exit aperture 36, the beam exit aperture and the beam exit opening 11.

In this embodiment, the insulation material preferably is trilead tetroxide. Plates or containers made of trilead tetroxide remarkably shield the X-ray. In an embodiment, the insulation material may be other lead oxides than trilead tetroxide. Compared with other material, such as lead or lead-antimony alloy, that also can remarkably shield the X-ray, the lead oxides have a lower density, a higher strength and excellent performances of electrical insulation and radiation protection.

As shown in FIG. 5 and FIG. 10, in this embodiment, the case body 1 comprises a main body portion 13, a first case cover 14 and a second case cover 15. The first case cover 14 and the second case cover 15 are fixedly provided at the two end openings of the main body portion 13, respectively. The main body portion 13 is integrally formed. The material for the first case cover 14 and the second case cover 15 is the same as that for the main body portion 13.

The integrally-formed main body portion 13 has a simple structure, a higher connection strength between respective portions and can be formed by a one-step molding process. Compared with a main body portion 13 formed by jointing plates (usually using screws or through a welding process), the integrally-formed main body portion 13 provides a good sealing effect and an improved leakage protection of the insulation liquid and the X-ray. Furthermore, during operation of the X-ray generator, and especially when the insulation liquid is injected into the case body 1 by using vacuum oil injection (after the insulation liquid is injected from an oil injection orifice 112 shown in FIG. 3 by using vacuum oil injection, a gasket and a sealing bolt 113 are used to seal the oil injection orifice 112), the air outside of the case body 1 will not penetrate the main body portion 13 into the case body 1, and thus negative influence of the air on heat dissipation and insulation effect of the insulation liquid can be avoided. In an embodiment, the main body portion 13 may be formed by jointing and splicing separate structures through welding or screw threaded connection. In that case, the first case cover 14, the second case cover 15 and the main body portion 13 may be made of different materials.

Figure 4:
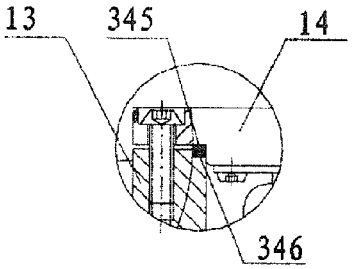
FIG. 4 is an enlarged schematic view showing a portion provided with a sealing strip of FIG. 3.
Figure 8:
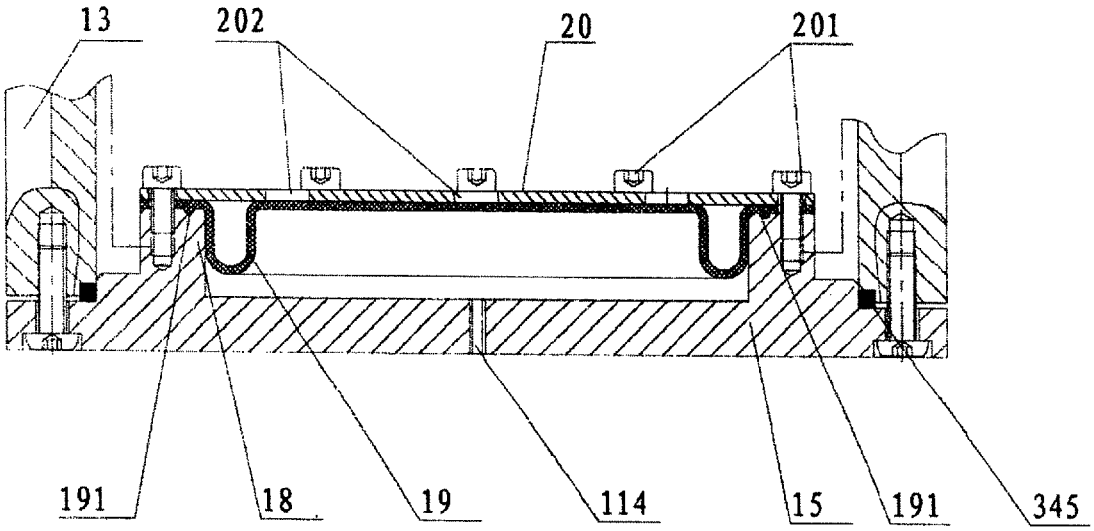
FIG. 8 is an enlarged schematic view, in cross-section, of a joint portion where a protrusion edge, an elastic diaphragm and a second case cover shown in FIG. 5 are connected together.

As shown in FIGS. 3-5, in this embodiment, sealing strips 345 as shown in FIG. 4 are provided between the first case cover 14 and the main body portion 13 and between the second case cover 15 and the main body portion 13 shown in FIG. 8. The sealing strips 345 are made of rubber material.

Specifically, as shown in FIG. 4, the end face of the main body portion 13 is provided with a step face 346 or a groove, and the sealing strip 345 is provided on the step face 346 or provided in the groove and extends beyond the end face of the main body portion 13. The first case cover 14 and the second case cover 15 are close to the surface of the main body portion 13 and press against the sealing strips 345.

In such structure, since the sealing strips 345 are pressed when being interposed between the first case cover 14 and the main body portion 13 and between the second case cover 15 and the main body portion 13, the sealing strip 345 can more tightly press against the first case cover 14 and the main body portion 13, an improved sealing effect can be achieved.

In the above structure, the sealing strips 345 may be made of other elastic material than rubber material. The sealing strip may be provided only between the first case cover 14 and the main body portion 13 or only between the second case cover 15 and the main body portion 13.

In an embodiment, as shown in FIG. 4, the step face 346 or groove may be provided on the edge of the first case cover 14, and/or as shown in FIG. 5, the step face 346 or groove may be provided on the edge of the second case cover 15. In that case, the sealing strip 345 is provided on the step face 346 or provided in the groove and extends beyond the edge of the first case cover 14 and/or the second case cover 15, and the main body portion 13 is close to the surface of the first case cover 14 and/or the second case cover 15 and presses against the sealing strip 345.

In this embodiment, as shown in FIG. 5, the main body portion 13 is made of aluminum or aluminum alloy with a high strength and a light weight and is formed by using a stretch forming process. The stretch forming process has a higher manufacture efficiency and can avoid leakage caused by deformation and defect of a welding structure. It should be noted that the case body may be formed by using wire electrode cutting or like and may be made of other material.

All in a word, the case 1 of aluminum alloy material formed by a stretch forming process and the shielding device 3 according to this embodiment have advantages over those in the prior art in volume and weight. Hence, the installation case for a radiation device according to this embodiment has an advantage of light weight and can be more easily processed, assembled, and conveyed.

Figure 9:
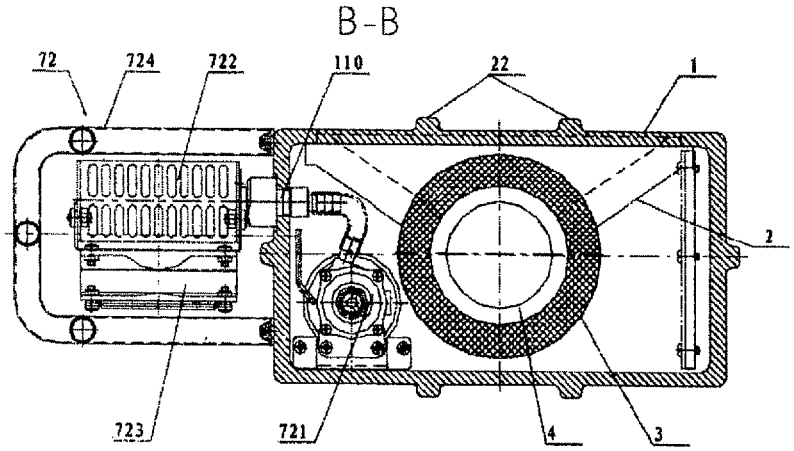
FIG. 9 is a schematic view, in cross-section, taken along B-B line of FIG. 3.
Figure 11:
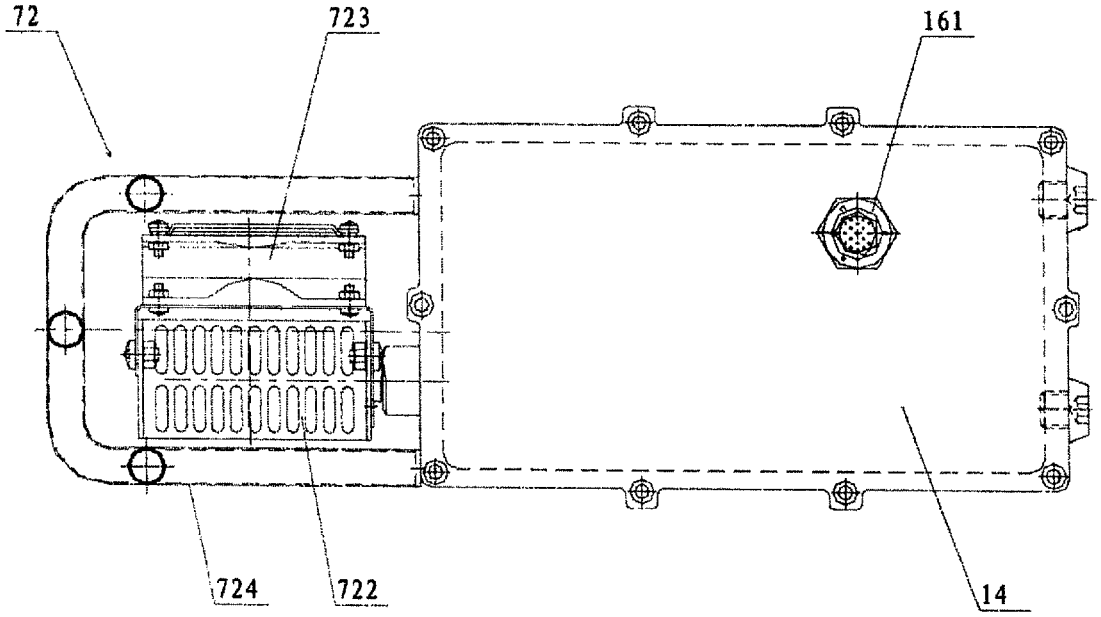
FIG. 11 is a top schematic view of the installation case for a radiation device of FIG. 9.

As shown in FIGS. 9 and 11, the oil-cooling circulation system according the embodiment comprises a liquid-filled box, the insulation liquid filled in the liquid-filled box and a cooling device 72 for reducing the temperature of the insulation liquid. The cooling device 72 comprises an oil pump 721, a heat radiator 722 and a cooling fan 723.

The liquid-filled box is constituted by the installation case for a radiation device according to the above-mentioned embodiment. The heat radiator 722 is located outside of the liquid-filled box. The liquid inlet of the heat radiator 722 is communicated with a liquid outlet of the liquid-filled box, and the liquid outlet of the heat radiator 722 is communicated with a liquid inlet of the liquid-filled box. The oil pump 721 provides a motive power for circulation between the insulation liquid in the liquid-filled box and the insulation liquid in the heat radiator 722. The cooling fan 723 dissipates the heat from the heat radiator 722 in such a way that the flow of ambient air around the heat radiator 722 is expedited.

In this embodiment, the insulation liquid is a 25# transformer insulation oil. The insulation liquid not only can, as an insulation medium, prevent respective elements or modules loaded with high voltage from breakdown or short circuit, but also can function as a heat dissipation medium. In an embodiment, the insulation liquid may use other insulation oils than the 25# transformer insulation oil.

The X-ray tube 4 can convert only about 1% of energy into the X-ray, and the rest of, about 99%, energy is converted into heat energy and acts on the anode 42 of the X-ray tube 4. Thus, in order to prevent the anode 42 of the X-ray tube 4 from being overheated and hence to prevent a target from being melted and damaged, it is necessary to externally connect with the oil pump 721 and the heat radiator 722 so as to perform circulated oil-cooling heat dissipation. Then, the cooled insulation liquid is returned back to the anode 42 of the X-ray 4, so that heat dissipation can be achieved.

In this embodiment, as shown in FIG. 1, an external power supply 8 coming from outside of the case body is 220V AC commercial power. It should be noted that the external power supply 8 may be a secondary battery or an industrial power.

By using the fluid channel 312 shown in FIG. 5, the insulation liquid freely flowing within the shielding device 3 and between the case body 1 and the shielding device 3 will transfer the heat generated by the X-ray tube 4 (mainly generated by the anode 42 of the X-ray tube 4) within the shielding device 3 and the case body 1, as shown in FIG. 5, to the heat radiator 722 under the driving provided by the oil pump 721 shown in FIG. 3 or 9, and then the transferred heat is dissipated by the flowing air. Hereafter, the insulation liquid cooled by the heat radiator 722 is input into the shielding device 3 and in between the case body 1 and the shielding device 3 again, and absorbs the heat generated by the X-ray tube 4 again.

When the cooling system is designed, not only the efficiencies of heat dissipation of the case body 1, the shielding device 3, the heat radiator 722 and the insulation liquid, but also the power consumption of the oil pump 721 shown in FIG. 3 or FIG. 9 should be synthetically considered, so that a cooling system, in which the heat dissipation performance thus designed can meet the whole heat dissipation requirements of the X-ray generator, can be achieved.

In an embodiment, the oil pump 721 may provide a motive power only for circulation between the insulation liquid in the shielding device 3 or the case body 1 and the insulation liquid in the heat radiator 722.

As shown in FIGS. 3 and 9, in this embodiment, the oil pump 721 is fixedly provided on the inner wall of the case body 1 (preferably, being fixedly provided on the first case cover 14 using screws or bolts), and is located between the case body 1 and the shielding device 3. The installation space between the case body 1 and the shielding device 3 is large and is suitable for installation of the oil pump 721.

In this embodiment, as shown in FIG. 3, a liquid suction port of the oil pump 721 faces toward a liquid outlet of the shielding device 3. A liquid inlet of the shielding device 3 is communicated with a liquid inputting pipe 35. A liquid inlet 111 of the case body 1 is communicated with a liquid introducing pipe 17. A liquid outputting port 170 of the liquid introducing pipe 17 faces toward a liquid inputting port 350 of the liquid inputting pipe 35.

In such structure, the oil pump 721 will pump the heat-carried insulation liquid from the liquid outlet of the shielding device 3 and output the heat-carried insulation liquid from a liquid outlet 110 of the case body 1 shown in FIG. 3 to the heat radiator 722. Arrangement of the liquid inputting pipe 35 and the liquid introducing pipe 17 can smoothen flowing of the insulation liquid.

In an embodiment, communication of the liquid suction port of the oil pump 721 with the liquid outlet of the shielding device 3 and/or communication of the liquid outputting port 170 of the liquid introducing pipe 17 with the liquid inputting port 350 of the liquid inputting pipe 35 can be achieved by using conduits. The oil pump 721 may be fixedly provided in the heat radiator 722, or may be, in part, fixedly provided between the liquid-filled box and the shielding device 3 and, in part, fixedly provided in the heat radiator 722. In a case where the number of the oil pump 721 is two or more, one or more of the oil pumps may be provided in the heat radiator 722 and the other one or more of the oil pumps may be located between the liquid-filled box and the shielding device 3.

As shown in FIG. 3 or 9, in this embodiment, the oil pump 721 is a DC brushless submersible pump which has a good seal, a reduced noise, a low power consumption, a stable performance and a long life span.

In an embodiment, the cooling fan 723 shown in FIG. 9 may employ other refrigeration devices, such as a refrigeration device used by a refrigerator or a refrigerating cabinet, to directly refrigerate the heat radiator 722 instead of using air flow to dissipate heat.

As shown in FIGS. 9 and 10, in this embodiment, the cooling device 72 further comprises a frame-shaped bracket 724 hooding the heat radiator 722 and the cooling fan 723. The bracket 724 is fixedly connected with two separate components of the case body 1.

The bracket 724 is formed by welding pipes of aluminum alloy material with a low density together. Such structure uses less material, and not only can protect the heat radiator 722 and the cooling fan 723, but also can be used as a handle for grasping of a user.

In an embodiment, the bracket 724 may be made of other material, may be formed by welding solid rods together, or may be formed by connection structure of screws or bolts with screw holes of rods. The bracket 724 may be replaced with other protection hoods with good ventilation.

As shown in FIGS. 1 and 2, the X-ray generator according to the embodiment comprises the X-ray tube 4, the high frequency and high voltage generator 5, a filament power supplying module 6 and the oil-cooling circulation system according to any one of the above embodiments of the present disclosure. The X-ray tube 4 is mounted within the shielding device 3 in the installation case for a radiation device. The X-ray emitted from the X-ray tube 4 passes through the ray exit aperture 36, the beam exit aperture (coincident with the ray exit aperture 36) and the beam exit opening 11 in this order, as shown in FIG. 5, and radiates out of the case body 1 of the installation case for a radiation device.

The high frequency and high voltage generator 5 is electrically connected with the cathode 41 and the anode 42 of the X-ray tube 4. The high frequency and high voltage generator 5 is used for providing a DC voltage to the anode 42 and the cathode 41 of the X-ray tube 4. The filament power supplying module 6 is electrically connected with the cathode 41 of the X-ray tube 4, and is used to provide the cathode 41 of the X-ray tube 4 with a high frequency pulse voltage which is sufficiently high for the cathode 41 of the X-ray tube 4 under its high voltage electric field to emit electron flow that can bombard the anode 42.

In this embodiment, the shielding device 3 is also provided with the circuit channel 311 as shown in FIG. 5. As shown in FIG. 1, the cathode of the high frequency and high voltage generator 5 is electrically connected with the cathode 41 of the X-ray tube 4 via wires passing through the circuit channel 311. The anode of the high frequency and high voltage generator 5 is electrically connected with the anode 42 of the X-ray tube 4 via wires that are electrically connected with the conductive screw 318 and the conductive stud 317. The filament power supplying module 6 is electrically connected with the cathode 41 of the X-ray tube 4 via wires passing through the circuit channel 311.

Parts of the modules constituting the high frequency and high voltage generator 5 are located between the case body 1 and the shielding device 3, and the external power supply 8 and the rest of the modules constituting the high frequency and high voltage generator 5 are located outside of the case body 1. The case body 1 is provided with a wire exit channel 16 shown in FIG. 3. The modules located in the case body 1 are electrically connected with the modules located outside of the case body 1 via interfaces passing through the wire exit channel 16.

In an embodiment, all modules constituting the high frequency and high voltage generator 5, that is, the entire high frequency and high voltage generator 5, a sampled-signal processing module 92 and a logic decision and control module 93 may be provided between the case body 1 and the shielding device 3. In that case, the above mentioned electric devices are electrically connected with external power supply circuits and signal transmitting circuits for telecommunication required for operation of these electric devices via interfaces passing through the wire exit channel 16. The above mentioned wires for electric connections may be replaced with interfaces, and vice versa.

Further, in this embodiment, parts of the modules constituting the high frequency and high voltage generator 5 shown in FIG. 1 may be located within the shielding device 3. In that case, those, located within the shielding device 3, of the modules constituting the high frequency and high voltage generator 5 shown in FIG. 1 are electrically connected with those, located between the case body 1 and the shielding device 3, of the modules constituting the high frequency and high voltage generator 5 shown in FIG. 1 or with the modules located outside of the case body 1 via wires or interfaces passing through the circuit channel 311 or the circuit channel 311 and the wire exit channel 16.

In this embodiment, both of the first end cover 31 and the second end cover 32 are provided with a dual-layer structure constituted by laminating the outer plate 331 and inner plate 332. Both of the first end cover 31 and the second end cover 32 are provided with the circuit channel 311.

The circuit channel 311 provided in the first end cover 31 comprises the cathode positioning aperture 313 provided in the inner plate 332 of the first end cover 31 and the wire routing aperture 340 provided in the outer plate 331 of the second end cover 32. In the X-ray tube 4, the sheath 315 for protecting the cathode 41 is embedded in the cathode positioning hole 313, and the wire routing aperture 340 comprises the longitudinal aperture 342 coincident with/parallel to the axial direction of the shielding device 3 and the transverse aperture 341 communicating with the longitudinal aperture 342. The axial direction of the transverse aperture 341 is perpendicular to the axial direction of the longitudinal aperture 342. In the X-ray tube 4, the sheath 315 for protecting the cathode 41 is embedded in the longitudinal aperture 342. The cathode 41 of the X-ray tube 4 is two wires extending beyond the transverse aperture 341 from the sheath 315.

The circuit channel 311 provided in the second end cover 32 comprises anode positioning apertures 316 provided in the inner plate 332 and the outer plate 331 of the second end cover 32. The conductive stud 317 orderly passes through the anode positioning apertures 316 provided in the inner plate 332 and the outer plate 331 of the second end cover 32. The conductive stud 317 is provided with an outer screw threaded portion which is engaged with an anode screw hole disposed in the anode 42. The portion of the conductive stud 317 far away from the anode 42 is provided with a positioning screw hole. The conductive screw 318 is provided with an outer screw threaded portion which is engaged with the positioning screw hole. Wires electrically connected with the anode of the high frequency and high voltage generator 5 are sandwiched between the head of the conductive screw 318 and the conductive stud 317.

An annular spacer is provided between the conductive screw 318 and the conductive stud 317. The wires electrically connected with the anode of the high frequency and high voltage generator 5 are sandwiched between the spacer and the head of the conductive screw 318.

Figure 12:
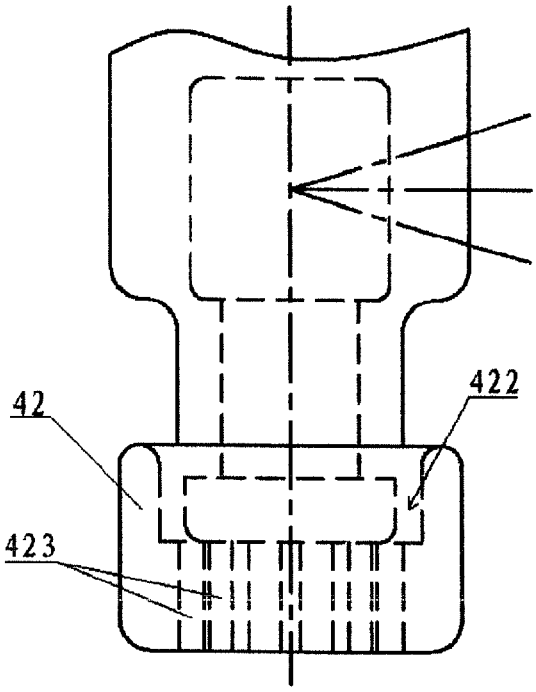
FIG. 12 is a perspective schematic view of an anode of an X-ray tube in the installation case for a radiation device according to an embodiment of the present disclosure.
Figure 13:
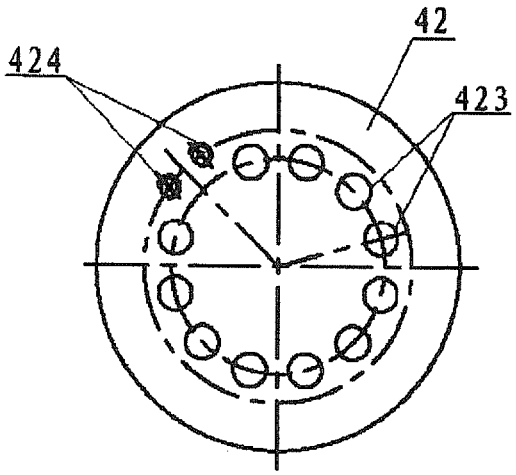
FIG. 13 is a bottom schematic view of the anode of the X-ray tube of FIG. 12.

In the present embodiment, as shown in FIG. 6, the inner plate 332 of the second end cover 32 is provided with at least one anode position-limit hole 320. As shown in FIGS. 12 and 13, the anode 42 is provided with a position-limit screw hole 424. A positioning stud 421 is provided with an outer screw threaded portion which is engaged with the position-limit screw hole 424. The end of the positioning stud 421 far away from the position-limit screw hole 424 is inserted into the anode position-limit hole 320.

The number of the positioning stud 421 is the same as that of the anode position-limit hole 320 and is two. It should be noted that the number of the positioning stud 421 and the anode position-limit hole 320 may be one or three or more.

In this embodiment, the first end cover 31 and the second end cover 32 are provided with fluid channels 312. Both of the first end cover 31 and the second end cover 32 are a dual-layer structure constituted by laminating the outer plate 331 and inner plate 332. There is the liquid flowing cavity 333 between the outer plate 331 and the inner plate 332. The inner plate 332 is provided with the flow guiding orifices 335 communicated with the liquid flowing cavity 333, and the outer plate 331 is provided with the flow guiding orifice 334 communicating with the liquid flowing cavity 333. The fluid channel 312 is constituted by the flow guiding orifice 334, the flow guiding orifices 335 and the liquid flowing cavity 333.

As shown in FIG. 12, the anode 42 is in a hood shape and covers the end of the glass hood of the X-ray tube 4 far away from the cathode 41. The liquid flowing space 422 is provided between the anode 42 and the outer circumferential surface of the glass hood of the X-ray tube 4, and the anode 42 is provided with the liquid circulating holes 423 communicating with the liquid flowing space 422. In the present embodiment, the axial direction of the liquid circulating hole 423 is preferably parallel to the axial direction of the X-ray tube 4. The insulation liquid outside the shielding device 3 flows into/flows out of the shielding device 3 through the fluid channel 312 of the second end cover 32, the liquid circulating holes 423 and the liquid flowing space 422.

In order to more effectively position the anode 42, one, two or more circumferential screw holes 420 are provided in the outer circumferential surface of the anode 42. The anode 42 is fixed in the shielding device 3 in the circumferential direction by passing screws through the cylindrical body 30 and inserting the screws into the circumferential screw holes 420.

For the sake of simplicity, FIG. 12 does not show holes for positioning the anode 42, i.e., the position-limit screw holes 424, and the circumferential screw holes 420 which are visible in FIG. 13. This structure can be easily assembled.

The transverse hole 341 and the longitudinal hole 342 form the wire routing aperture 340 in a shape of right-angle polyline. Such structure can ensure that the X-ray emitted from the X-ray tube 4 does not come out of the wire routing aperture 340 while the wire is led out from the wire routing aperture 340. In an embodiment, the wire routing aperture 340 may be an oblique through hole or a through hole in other bent shapes, such as a sharp-angle polyline shape or an obtuse-angle polyline shape.

In the present embodiment, as shown in FIG. 5, the liquid outlet of the shielding device 3 is located in the fluid channel 312 of the first end cover 31, and the liquid inlet of the shielding device 3 is located in the fluid channel 312 of the second end cover 32.

Since the heat emitted by the X-ray tube 4 mainly comes from the anode 42 of the X-ray tube 4, when the liquid inlet of the shielding device 3 is located in the second end cover 32, the liquid inlet is closer to the anode 42 of the X-ray tube 4, and the insulation liquid with a lower temperature will contact with the anode 42 of the X-ray tube 4 first and take the heat from the anode 42 of the X-ray tube 4 away. In this way, the target of the anode of the X-ray tube 4 can be prevented from being burned out due to excessive heat. The target is located at a position where the X-ray is emitted from the right side in the glass hood (at the center line), as shown in FIG. 12.

In this embodiment, constituent modules of the high frequency and high voltage generator 5 shown in FIG. 1 are a first rectification and voltage regulation module 51, a high frequency inverter 52, a high voltage transformer 53 and a voltage-doubling rectification module 54 which are electrically connected with each other in this order. The first rectification and voltage regulation module 51 is electrically connected with the external power supply 8, and takes electrical energy required for loading a DC high voltage on the cathode 41 and the anode 42 of the X-ray tube 4 from the external power supply 8. The voltage-doubling rectification module 54 is electrically connected with the cathode 41 and the anode 42 of the X-ray tube 4.

In the constituent modules of the high frequency and high voltage generator 5, the high voltage transformer 53 and the voltage-doubling rectification module 54 are fixedly provided between the case body 1 and the shielding device 3 shown in FIG. 2. The high voltage transformer 53 shown in FIG. 2 is fixedly provided on the collimator 2. It should be noted that the high voltage transformer 53 may be fixedly provided on a PCB board, the first case cover 14 or the second case cover 15. The voltage-doubling rectification module 54 is fixedly provided on a circuit board.

At least one of the two ends of the circuit board (FIG. 3 shows the end the height of the position of which is higher.) bears against a position-limit protruding piece 145 fixedly provided on the first case cover 14 or a position-limit protruding piece 145 fixedly provided on the second case cover 15 (FIG. 3 only shows the position-limit protruding piece 145 fixedly provided on the first case cover 14.). The circuit board is fixed on the position-limit protruding pieces 145 by fasteners (preferably made of nylon material).

In this embodiment, there are many ways for fixedly connecting the circuit board fixedly provided with the voltage-doubling rectification module 54 with the case body 1. For instance, at least one of the two ends of the circuit board may be inserted into a groove provided on the first case cover 14 or the second case cover 15, and the middle region of the circuit board may be fixed on the main body portion 13 by fasteners. The fasteners are used for preventing vibration or deformation of the circuit board, so that the voltage-doubling rectification module 54 can be prevented from being damaged due to vibration.

The above fixing and assembling arrangement of the constituent modules of the high frequency and high voltage generator 5 shown in FIG. 1 provides a compact structure, and the space within the case body 1 can be adequately used.

In an embodiment, the voltage-doubling rectification module 54 may be fixedly provided on the surface of the shielding device 3, and the high voltage transformer 53 may be fixedly provided on the side of the first case cover 14 or the second case cover 15 contacting with the insulation liquid.

In this embodiment, the first rectification and voltage regulation module 51 is fixedly provided outside of the case body 1, and comprises a full bridge rectification module and a BUCK chopping voltage regulation module. The full bridge rectification module converts the AC supplied by the external power supply 8 into DC. The BUCK chopping voltage regulation module is used for converting a fixed DC voltage into a variable DC voltage, i.e., DC/DC convert. Then the converted DC voltage is input into the high frequency inverter 52.

The high frequency inverter 52 is also fixedly provided outside of the case body 1 and employs a full bridge series-parallel resonance high-frequency inverter circuit to inversely convert a low voltage DC into a high frequency and low voltage AC.

The high voltage transformer 53 is used for boosting the voltage output from the high frequency inverter 52 and then inputting the boosted voltage into the voltage-doubling rectification module 54.

The voltage-doubling rectification module 54 employs a multi-stage (more than two stages) voltage-doubling rectification circuit, and provides boosting and rectifying (AC to DC) functions.

Since the high voltage transformer 53 and the voltage-doubling rectification module 54 are usually loaded with a high voltage of about 1 kV or more, when the high voltage transformer 53 and the voltage-doubling rectification module 54 are fixedly provided between the case body 1 and the shielding device 3 and are immersed in the insulation liquid, the insulation liquid can avoid breakdown caused by the high voltage loaded on the high voltage transformer 53 and the voltage-doubling rectification module 54, and the heat generated in the high voltage transformer 53 and the voltage-doubling rectification module 54 can be taken away by the flowing insulation liquid.

As shown in FIGS. 1 and 3, in the present embodiment, the X-ray generator also comprises a monitor system. As shown in FIG. 1, the monitor system comprises a signal sampling module 91, the sampled-signal processing module 92, the logic decision and control module 93, and an auxiliary power supply module 94 configured to supply power for the logic decision and control module 93.

The signal sampling module 91 is located between the case body 1 and the shielding device 3. The installation space between the case body 1 and the shielding device 3 is large and is suitable for installation of the signal sampling module 91. In an embodiment, the signal sampling module 91 may be mounted within the shielding device 3.

The signal sampling module 91 is used for detecting electric signals on the cathode 41 and the anode 42 of the X-ray tube 4, the temperature of the insulation liquid and the flow rate of the insulation liquid flowing into the case body 1, and sends the detected electric signals to the sampled-signal processing module 92.

The sampled-signal processing module 92 is electrically connected with the signal sampling module 91 and the logic decision and control module 93. The sampled-signal processing module 92 is configured for processing, such as filtering, the electric signals received from the signal sampling module 91 and eliminating related interference signals, and converting the electric signals into the detection result in a digital form (e.g., in a binary form) through analog-digital conversion and then sending the detection result in a digital form to the logic decision and control module 93.

In the present embodiment, the logic decision and control module 93 realizes external data interaction through a series communication interface 95 shown in FIG. 1. It should be noted that the external data interaction may be realized through other communication interfaces or wires, or even may be realized by sending or receiving wireless signals.

The logic decision and control module 93 may not output the detection result, but automatically call previously-stored control instructions according to the detection result based on predetermined correspondence rules between the detection result and the control instructions, and control parts or all of the output voltage and/or current of the high frequency and high voltage generator 5, the output voltage and/or current of the filament power supply module 6 and the power consumption of the oil pump 721 according to the corresponding control instructions. In this way, a high degree of automatization can be realized.

As shown in FIG. 1, the signal sampling module 91 comprises a kV/mA sampling circuit 911, a temperature sensor 912 and a flow sensor 913.

The kV/mA sampling circuit 911 is configured for detecting voltage and/or current on a high voltage loop constituted by the cathode 41 and the anode 42 of the X-ray tube 4. The kV/mA sampling circuit 911 mainly comprises a kV high voltage voltage-divider, a mA sampling resistor and a flashover mutual-inductor. The kV/mA sampling circuit 911 is integrally formed with the voltage-doubling rectification module 54 shown in FIG. 2. It should be noted that the kV/mA sampling circuit 911 and the voltage-doubling rectification module 54 may be formed separately and be electrically connected with each other.

The temperature sensor 912 is used for detecting the temperature of the insulation liquid.

The flow sensor 913 is used for detecting the flow rate of the insulation liquid passing through the fluid channel 312 shown in FIG. 5.

In this embodiment, the electric signals output by the temperature sensor 912 and the flow sensor 913 are in the form of on-off value (in a binary form), and no analog-to-digital conversion is needed. In this way, workload of the sampled-signal processing module 92 is reduced. It should be noted that the electric signals output by the temperature sensor 912 and the flow sensor 913 may be in an analog form.

The types of fault signals sampled by the signal sampling module 91 comprise a flow rate fault signal, a temperature fault signal and a flashover fault signal.

When the flow rate is not within a predetermined range, the electric signal fed back to the sampled-signal processing module 92 and representative of the out-of-limit flow rate is regarded as the flow rate fault signal. As such, when the temperature goes beyond the predetermined value, the electric signal fed back to the sampled-signal processing module 92 and representative of excess temperature is regarded as the temperature fault signal. In a case where the sampled voltage and/or current values are abnormal, whether a flashover failure is present or not can be determined according to the abnormal voltage and/or current values, and thus the abnormal voltage and/or current values can be regarded as the flashover fault signal.

As shown in FIG. 3, the flow sensor 913 is fixedly provided on the liquid introducing pipe 17 of the case body 1. The insulation liquid entering the case body 1 from the heat radiator 722 will pass through the liquid introducing pipe 17. Therefore, the arrangement of the flow sensor 913 being provided on the liquid introducing pipe 17 can precisely detect the flow rate of the insulation liquid entering the case body 1. It should be noted that the flow sensor 913 may be fixedly provided on the liquid outlet 110 of the case body 1. In that case, the flow rate of the insulation liquid flowing out of the case body 1 can be detected. Since the amount of the insulation liquid in the case body 1 is constant, the flow rate of the insulation liquid entering the case body 1 can be inversely derived by detecting the flow rate of all of the insulation liquid flowing out of the case body 1.

As shown in FIG. 3, the temperature sensor 912 is fixedly provided in the vicinity of the wire exit channel 16 provided in the case body 1. In this way, the temperature sensor 912 can be led out from the wire exit channel 16 more easily.

In this embodiment, as shown in FIG. 1, the filament power supply module 6 comprises a second rectification and voltage regulation module 61 electrically connected with the logic decision and control module 93, a filament inverter 62 and a filament transformer 63 electrically connected with the filament inverter 62 and the cathode 41 of the X-ray tube 4.

The filament inverter 62 has a half bridge structure. The filament transformer 63 is fixedly provided at a portion of the inner wall of the main body portion 13 (shown in FIG. 2) which is close to the first case cover 14. The filament transformer 63 is a step-down transformer which is configured to convert the voltage output from the filament inverter 62 into a high frequency pulse voltage required for the cathode 41 of the X-ray tube 4 and to output the high frequency pulse voltage to the cathode 41 of the X-ray tube 4.

An interface passing through the wire exit channel 16 provided in the case body 1 shown in FIG. 3 is an aviation plug 161 that provides liquid and gas seal between the inside of the case body 1 and the outside of the case body 1. The high voltage transformer 53 and the high frequency inverter 52, the signal sampling module 91 and the sampled-signal processing module 92, and the filament inverter 62 and the filament transformer 63 are electrically connected with each other via aviation plugs 161, respectively.

The voltages applied to the first rectification and voltage regulation module 51, the high frequency inverter 52 and the logic decision and control module 93 are lower. In this embodiment, in order to save the volume of the case body 1 and facilitate installation, detachment, electrical connection and/or parameter setting, the first rectification and voltage regulation module 51, the high frequency inverter 52, the logic decision and control module 93, the second rectification and voltage regulation module 61, the filament inverter 62 and the auxiliary power supply module 94 all are fixedly provided on the outer surface of the case body 1. It should be noted that the first rectification and voltage regulation module 51, the high frequency inverter 52, the second rectification and voltage regulation module 61, the filament inverter 62 and the logic decision and control module 93 may be fixedly provided in a control box provided outside of the case body 1. The control box may be fixedly provided on the outer surface of the case body 1, or may be separately provided on a shelf or a machine case. Related electric signals coming from the control box may be electrically connected with the aviation plug 161 (shown in FIG. 3) via wires passing through the control box.

As shown in FIGS. 3 and 10, the aviation plug 161 has a good seal, can be easily mounted and can provide stable electric signal transmission. The interfaces may be combination of wires and sealing members, such as a sealing ring.

It should be noted that the high voltage transformer 53 and the high frequency inverter 52, the signal sampling module 91 and the sampled-signal processing module 92, and the filament inverter 62 and the filament transformer 63 may be, in part, electrically connected with each other via the aviation plugs 161, and may be, in part, electrically connected with each other via wires or other interfaces, respectively.

In this embodiment, as shown in FIG. 2, the collimator 2 is provided with a plurality of screw holes 21 the number of which is more than two, and the case body 1 is provided with mounting holes that are coaxial with the screw holes 21. The case body 1 (the main body portion 13, as shown in FIG. 5) is fixedly connected with the collimator 2 via screws orderly passing through the mounting holes and the screw holes 21.

The connection structure constituted by the screw holes 21 and the screws can be easily assembled and detached. When the X-ray tube 4 according to the present embodiment is mounted, the oil pump 721, the filament transformer 63, the circuit board provided with the voltage-doubling rectification module 54 and the aviation plug 161 are integrally mounted on the first case cover 14 first, and then the X-ray tube 4 is mounted between the first end cover 31 and the second end cover 32 of the shielding device 3. After related electrical connections are completed, the whole structure is pushed into the case body 1. Then, the shielding device 3 (including the collimator 2) is fixed on the main body portion 13 shown in FIG. 5 through screws, and the oil introducing pipe 17 and the oil outlet 110 are connected with each other. Finally, the first case cover 14 and the second case cover 15 are hermetically fixed on the main body portion 13.

It should be noted that the screws may be replaced with other fasteners, such as bolts or studs, which are provided with screw threads. As shown in FIG. 2, the number of the screw holes 21 may be one, one row or a plurality of rows (two rows or more). The specific number of the screw holes 21 can be set according to practical requirements (e.g., the size of the screws or bolts suitable for an installation site).

As shown in FIGS. 5 and 8, in this embodiment, the installation case for a radiation device comprises the case body 1 as described above, a protrusion edge 18 fixedly provided on the inner wall of the case body 1 and in a ring shape, and a compensation device which is liquid-hermetically and fixedly connected or liquid-hermetically and movably connected with the protrusion edge 18.

One of two sides of the compensation device, the inner wall of the case body 1 and the protrusion edge 18 form a liquid receiving chamber for receiving the insulation liquid.

The inner wall of the case body 1 opposite to the other one of the two sides of the compensation device and the inner wall of the protrusion edge 18 form a compensation device moving space configured to allow the compensation device to deform or move along a direction approaching to or away from the insulation liquid.

In the present disclosure, since the protrusion edge 18 is provided on the inner wall of the case body 1, the compensation device is liquid-hermetically and fixedly connected or liquid-hermetically and movably connected with the protrusion edge 18. When the case body 1 comprises the main body portion 13, the first case cover 14 and the second case cover 15 shown in FIG. 5, the components can be assembled into the complete case body after the compensation device has been separately mounted on the protrusion edge 18 on the second case cover 15. Thus, assembly of the compensation device and assembly of the case body can be separately carried out. Such separate assemblies are laborsaving and convenient and can reduce installation errors. Furthermore, since the height of the protrusion edge 18 can be designed according to practical requirements, the depth and size of the compensation device moving space also can be designed according to practical requirements. The protrusion edge 18 not only can provide a function of fixing the compensation device, but also can guide the orientation of deformation or movement of the compensation device, and thus the orientation of deformation or movement of the compensation device will be more regular. Besides, since the inner diameter of the protrusion edge 18 is less than that of the second case cover 15, the required area of the compensation device will be less than that of the second case cover 15 in this embodiment, and the material used for the compensation device will be less. Further, the operation of connection of the protrusion edge 18 with the compensation device is performed in the case body 1, and good liquid seal can be achieved.

In this embodiment, as shown in FIG. 5 or 8, the compensation device is an elastic diaphragm 19 that is fixedly connected with an opening of the protrusion edge 18 away from the inner wall of the case body 1 and covers the opening of the protrusion edge 18 away from the inner wall of the case body 1. The elastic diaphragm 19 can deform along the direction approaching to or away from the insulation liquid within the compensation device moving space.

When the insulation liquid is subject to an thermal expansion phenomenon, the volume of the insulation liquid will expand and will press the elastic diaphragm 19 to deform along the direction away from the insulation liquid, i.e., the direction approaching to the second case cover 15; when the insulation liquid is subject to a cold contraction phenomenon, the volume of the insulation liquid will contract, and the elastic diaphragm 19 will deform along the direction approaching to the insulation liquid, i.e., the direction away from the second case cover 15, and press the insulation liquid, so that the thermal expansion and cold contraction of the insulation liquid can be compensated by elastic deformation of the elastic diaphragm 19. In this way, the case body 1 can be ensured to be filled with the insulation liquid throughout, and the pressure applied to everywhere in the case body 1 and respective electric elements by the insulation liquid will be substantially constant. Thus, the case body 1 and the electric elements within the case body 1 will not be damaged due to excess pressure from the insulation liquid. Meanwhile, when the oil is injected into the case body 1 by using vacuum oil injection, the elastic diaphragm 19 will press the insulation liquid in an elastic deformation manner after the injection operation of the insulation liquid into the case body 1 is finished. In this way, it can be ensured that the insulation liquid fills the entire case body 1, and hence the oil amount in the case body 1 can meet the requirements.

It should be noted that the compensation device may be a piston (not shown in Figs.) provided in the protrusion edge 18 shown in FIG. 2. The piston can slideably move in the compensation device moving space along the direction approaching to or away from the insulation liquid. In that case, a dropping-out preventing structure for preventing the piston from getting out of the protrusion edge 18 can be provided between the piston and the inner wall of the protrusion edge 18. The dropping-out preventing structure may be a protruding side edge fixedly provided on the inner wall of the protrusion edge 18 away from the insulation liquid. The protruding side edge may be integrally formed with the inner wall of the case body.

In this embodiment, as shown in FIG. 5, the case body 1 is further provided with an air guiding aperture 114 communicating with the ambient air (outside of the case body 1) and the compensation device moving space. The elastic diaphragm 19 will press the air in the compensation device moving space when the elastic diaphragm 19 deforms along the direction approaching to the second case cover 15, so that the air in the compensation device moving space will be discharged from the air guiding aperture 114; when the elastic diaphragm 19 deforms along the direction away from the second case cover 15, the air outside of the case body 1 will flow into the compensation device moving space, so that the elastic diaphragm 19 is ensured to deform in the compensation device moving space more easily. The size of the diameter of the air guiding aperture 114 can be designed according to practical requirements.

The arrangement of the compensation device moving space enlarges the space for elastic deformation of the elastic diaphragm 19. It should be noted that in order to realize function of the elastic diaphragm 19, other elastic structures or elastic members may be provided in the case body 1 to replace the above structure. Further, relevant movement and protection design is needed. For instance, an inflatable bag communicating with the air guiding aperture 114 and having an elasticity is fixedly provided in the case body 1, and the joint portion of the inflatable bag with the air guiding aperture 114 is liquid-hermetical, so that the insulation liquid can be prevented from leaking out of the case body 1 from the joint portion of the inflatable bag with the air guiding aperture 114. The inflatable bag communicates with the ambient air via the air guiding aperture 114. The inflatable bag follows the same principle of compensating thermal expansion and cold contraction of the insulation liquid in an elastic deformation manner as acted by the elastic diaphragm 19. However, when the oil is injected into the case body 1 by using an external vacuum oil injection, if there is no protection measure for the inflatable gas, then the inflatable gas should be ensured to be filled with an appropriate amount of the air all the time, so that it can be ensured that the inflatable bag can always apply a certain elastic pressure to the insulation liquid, or at the same time the inflatable bag is evacuated, so that it can prevent the inflatable bag from being broken due to expansion. Further, sealing problem also exists in the technical scheme including the inflatable bag.

In this embodiment, as shown in FIG. 5, the side of the elastic diaphragm 19 away from the inner wall of the case body 1 is provided with a pressing plate 20. The edge of the pressing plate 20 bears the edge of the elastic diaphragm 19 against the protrusion edge 18, and the edge of the pressing plate 20 is fixedly connected with the protrusion edge 18 via fasteners 201. A plurality of through holes 202 (more than two) through which the insulation liquid can freely pass are provided in the middle region of the pressing plate 20, as shown in FIG. 5.

In this embodiment, the side of the elastic diaphragm 19 close to the protrusion edge 18 or the side of the elastic diaphragm 19 close to the pressing plate 20 is fixedly provided with at least one protrusion portions 191 in a convex shape, and the protrusion edge 18 or the pressing plate 20 is provided with recesses in a concave shape. The protrusion portions 191 are engaged in the recesses.

The engagement structure of the protrusion portion 191 and the recesses provides a more reliable seal. Preferably, the protrusion portion 191 and the recesses are interference-fitted to each other.

In this embodiment, the protrusion portion 191 is in an annular shape. The axis of the protrusion portion is coincident with that of the protrusion edge 18. With such structure, sealing between the entire protrusion edge 18 and the elastic diaphragm 19 is more reliable.

The pressing plate 20 functions to reliably fix the elastic diaphragm 19 and to prevent damage of the elastic diaphragm 19 caused by the elastic diaphragm 19 excessively extending beyond the protrusion edge 18 due to deformation. At the same time, the plurality of through holes 202 in the pressing plate 20 can ensure that the insulation liquid can contact with the elastic diaphragm 19, so that the elastic diaphragm 19 can play a role. The design of the pressing plate 20 enables the X-ray generator to be adapted to oil injection conducted outside of a vacuum apparatus and oil injection conducted inside of a vacuum apparatus. In an embodiment, the pressing plate 20 may be replaced with a sieve or other fixing structures.

In this embodiment, as shown in FIGS. 5 and 8, the middle region of the side of the elastic diaphragm 19 close to the pressing plate 20 is in a folded shape. The elastic diaphragm 19 in the folded shape has a better elasticity. Since the side edge region of the elastic diaphragm 19 is relatively flat, once the portion of the elastic diaphragm 19 in the folded shape is directly placed on the middle portion of the protrusion edge 18, the elastic diaphragm 19 can be aligned with the protrusion edge 18 and the elastic diaphragm 19 can be easily mounted.

In this embodiment, as shown in FIG. 5, the side edge of the pressing plate 20 is fixedly connected with the protrusion edge 18 via the fasteners 201. The fasteners 201 are screws or other fasteners.

As shown in FIG. 5, in this embodiment, the protrusion edge 18 is integrally formed with the second case cover 15. Such structure facilitates formation in a one-step molding process, and compared with the structure formed by assembling separate components, connection strength between respective components of such structure is stronger. In an embodiment, the protrusion edge 18 may be integrally formed with one of the first case cover 14 and the main body portion 13, or the protrusion edge 18 and one of the first case cover 14, the second case cover 15 and the main body portion 13 may be separately formed and are fixedly connected with each other. The number of the protrusion edge 18 in the case body 1 may be one or two or more, depending on the amount of thermal expansion and cold contraction of the insulation liquid.

In this embodiment, as shown in FIGS. 5 and 10, on the outer surface of the main body portion 13, there is provided a plurality of reinforcement ribs 22 (more than two) that are integrally formed with the main body portion 13. The reinforcement ribs 22 are provided with screw holes 21 and are symmetrically provided on the main body portion 13.

On one hand, the reinforcement ribs 22 can reinforce the strength of the main body portion 13, and on the other hand, the screw holes 21 of the reinforcement ribs can be detachably connected with other external devices or frames.

In an embodiment, the reinforcement ribs 22 may be provided on the first case cover 14 or the second case cover 15, and the number of the reinforcement rib may be one.

As shown in FIGS. 2, 3 and 5, in this embodiment, the protrusion edge 18 is in a circular annular shape. The profile of the cross-section of the protrusion edge 18 is a circle. The pressing plate 20 is in a circular disk shape. The fasteners 201 are distributed on the pressing plate 20, the elastic diaphragm 19 and the protrusion edge 18 at equal angle intervals in the circumferential direction of the pressing plate 20.

With such structure, the pressing forces to which the pressing plate 20, the elastic diaphragm 19 and the protrusion edge 18 are subject and applied by the fasteners 201 are more even. The pressing plate 20, the elastic diaphragm 19 and the protrusion edge 18 (especially the elastic diaphragm 19) are unlikely to be damaged, and fixed connections between them are more reliable.

It should be noted that the cross-section of the protrusion edge 18 may be in an elliptical shape, a triangular shape, a rectangular shape (including an oblong shape and a square shape) or one of other polygons than the triangular shape and the rectangular shape. In a case where the cross-section of the protrusion edge 18 is rectangular, the pressing plate 20 is a rectangular plate. The protrusion edge 18 and the pressing plate 20, the elastic diaphragm 19 and the like provided on it can be provided on the shielding device 3. For instance, these components can be provided on the cylindrical body 30, the first end cover 31 or the second end cover 32. In that case, the shielding device 3 may be substantively regarded as an installation case for a radiation device which is also within the scope of the present disclosure.

In this embodiment, the material for the elastic diaphragm 19 is nitrile-butadiene rubber. It should be noted that the elastic diaphragm 19 may be made of other oil-resistant elastic material, such as fluoro-rubber material.

It should be noted that the above embodiments only are examples for explaining the present disclosure and are not intended to limit the present disclosure. Although preferred embodiments for the general concept of the present disclosure have been shown and explained in details, the skilled person in the art will appreciate that modifications to the above embodiments or equivalent replacement to part of the technical features can be carried out without departing from the spirit and principle of the present general inventive concept. The scope of the present disclosure should be defined by the appended claims and equivalents thereof.

What is claimed is:

1. An installation case for a radiation device comprising:

a case body; and a collimator fixedly connected with the case body, the collimator being provided with a beam exit aperture and the case body being provided with a beam exit openings;

at least a layer of shielding device provided within the case body, the at least a layer of shielding device is made of a material that can shield a radioactive ray, and between the at least a layer of shielding device and the case body, there is a space in which liquid can flow and parts can be installed;

wherein the collimator and the at least a layer of shielding device are integrally formed, or the collimator and the at least a layer of shielding device are two separate parts and are fixedly connected with each other; wherein the at least a layer of shielding device is provided with a ray exit aperture, and wherein the ray exit aperture, the beam exit aperture, and the beam exit opening are coaxial; and wherein the at least a layer of shielding device is in a cylindrical or prismatic shape and comprises a cylindrical body including two end openings, a first end cover and a second end cover, wherein the first end cover and the second end cover are fixedly connected with the two end openings of the cylindrical body, respectively, and at least one of the first end cover, the second end cover, and the cylindrical body is provided with a fluid channel and/or a circuit channel.

2. The installation case for a radiation device according to claim 1, wherein:

the radioactive ray is an x-ray;

the at least a layer of shielding device is made of insulation material;

with the at least a layer of shielding device comprises multiple layers of shielding device of which an inner layer of the multiple layers of shielding device is located inwardly of an outer layer of the multiple layers of shielding device, and between the inner layer of the multiple layers of shielding device and the outer layer of the multiple layers of shielding device, and between the case body and an outermost layer of the multiple layers of shielding device, there are spaces for flowing of liquid and mounting of parts.

3. The installation case for a radiation device according to claim 2, wherein: the circuit channel and/or the fluid channel is a through hole in a bent shape or an oblique hole provided in at least one of the first end cover, the second end cover and the cylindrical body; or at least one of the first end cover, the second end cover and the cylindrical body is in a dual-layer structure that is formed by superimposing an outer plate and an inner plate, and wherein a liquid flowing cavity is provided between the outer plate and the inner plate, and both of the outer plate and the inner plate are provided with a flow guiding orifice communicating with the liquid flowing cavity, and the fluid channel is constituted by the flow guiding orifices and the liquid flowing cavity, and the orthographic projection of the flow guiding orifice in the outer plate in the axial direction thereof and the flow guiding orifice provided in the inner plate are entirely staggered.

4. The installation case for a radiation device according to claim 3, wherein: the bent shape is a right-angle polygonal-line shape;

both of the first and second end covers are provided with the fluid channels and the circuit channels;

a plurality of the flow guiding orifices are distributed on the outer plate or the inner plate of the first end cover or the second end cover along the circumferential direction of the cylindrical body at equal angle intervals, and the distances between the respective flow guiding orifices and the axis of the cylindrical body are equal with each other;

the cylindrical body is provided with inner screw threaded tubes embedded therein, and the inner screw threaded tubes each are provided with inner screw thread, and the portion of a connection bolt having outer screw thread passes through the outer plate and engages with the inner screw thread of the inner screw threaded tube, so that the cylindrical body and the first and second end covers are connected and fixed together;

the inner plate is fixedly provided with a positioning pole which is embedded in a positioning counter bore in the outer plate and is tightly fitted with the positioning counter bore;

a step portion in a step shape is provided at the inside end edge of the cylindrical body, and the step portion bears against the edge of the inner plate.

5. The installation case for a radiation device according to claim 1, wherein: the shielding device is made of lead oxide;

the beam exit opening is filled with a blocking window, and the blocking window is made of a material through which the radioactive ray can transmit, and the blocking window functions to realize liquid and gas seal between the inside of the case body and the outside of the case body;

the case body comprises a main body portion including two end openings, a first case cover and a second case cover, wherein:

the first case cover and the second case cover are fixedly provided at the two end openings of the main body portion, respectively, the main body portion is integrally formed, and the material for the first case cover and the second case cover is the same as that for the main body portion.

6. The installation case for a radiation device according to claim 5, wherein: the shielding device is made of trilead tetroxide;

the main body portion is made of aluminum or aluminum alloy material and is formed by using a stretch forming process or a wire electrode cutting process;

sealing strips are provided between the first case cover and the main body portion and/or between the second case cover and the main body portion, wherein: the end face of the main body portion is provided with a step face or a groove, and the sealing strip is provided on the step face or provided in the groove and extends beyond the end face of the main body portion, and the first case cover and/or the second case cover are close to the surface of the main body portion and press against the portions of the sealing strips extending beyond the end face of the main body portion, or a step face or groove is provided on an edge of the first case cover and/or the second case cover, the sealing strip is provided on the step face or provided in the groove and extends beyond the edge of the first case cover and/or the second case cover, and the main body portion is close to the surface of the first case cover and/or the second case cover and presses against the portions of the sealing strips extending beyond the edge of the first case cover and/or the second case cover.

7. An oil-cooling circulation system, comprising:

a liquid-filled box filled with an insulation liquid; and a cooling device for reducing the temperature of the insulation liquid, and the cooling device comprises an oil pump, a heat radiator including a liquid inlet, a liquid outlet, and a cooling fan;

wherein:

the liquid-filled box is constituted by an installation case for a radiation device, the installation case comprising a case body and a collimator fixedly connected with the case body, the collimator being provided with a beam exit aperture and the case body being provided with a beam exit opening, the installation case further comprising a layer or layers of shielding devices provided within the case body, the layer or layers of shielding devices being made of a material that can shield a radioactive ray, and defining, between the layer or layers of shielding devices and the case body, a space in which liquid can flow and parts can be installed, the layer or layers of shielding devices being in a cylindrical or prismatic shape and comprising a cylindrical body including two end openings, a first end cover and a second end cover, wherein the first end cover and the second end cover are fixedly connected with the two end openings of the cylindrical body, respectively, and at least one of the first end cover, the second end cover, and the cylindrical body is provided with a fluid channel and/or a circuit channel;

the heat radiator is located outside of the liquid-filled box, the liquid inlet of the heat radiator is communicated with a liquid outlet of the liquid-filled box, and the liquid outlet of the heat radiator is communicated with a liquid inlet of the liquid-filled box;

the oil pump provides a motive power for circulation between the insulation liquid in the liquid-filled box and the insulation liquid in the heat radiator;

the cooling fan dissipates the heat from the heat radiator in such a way that the flow of ambient air around the heat radiator is expedited.

8. The oil-cooling circulation system according to claim 7, wherein:

the cooling device further comprises a frame-shaped bracket hooding the heat radiator and the cooling fan, and the bracket is fixedly connected with the liquid-filled box;

the oil pump is a DC brushless submersible pump;

the oil pump is fixedly provided on the inner wall of the liquid-filled box and is located between the liquid-filled box and the layer or layers of shielding devices, or the oil pump is fixedly provided in the heat radiator; and the oil-cooling circulation system further comprising a liquid outlet and a liquid inlet located in the fluid channel;

the oil pump comprising a liquid suction port facing toward the liquid outlet of the layer or layers of shielding devices, or the liquid suction port of the oil pump being in fluid communication with the liquid outlet of the layer or layers of shielding devices via a conduit;

wherein the liquid inlet of the layer or layers of shielding devices is communicated with a liquid inputting pipe, the liquid outlet of the liquid-filled box is communicated with a liquid introducing pipe, and a liquid outputting port of the liquid introducing pipe faces toward a liquid inputting port of the liquid inputting pipe, or the liquid inlet of the layer or layers of shielding devices is communicated with the liquid outlet of the liquid-filled box via a conduit.

9. An X-ray generator comprising:

an X-ray tube comprising a cathode and an anode, a high frequency and high voltage generator, a filament power supplying module and the oil-cooling circulation system according to claim 7, wherein:

the X-ray tube is mounted within the layer or layers of shielding devices, and the X-ray emitted from the X-ray tube passes through the ray exit aperture, the beam exit aperture, and the beam exit opening in this order and radiates out of the case body of the installation case for a radiation device;

the high frequency and high voltage generator is electrically connected with the cathode and the anode of the X-ray tube;

the filament power supplying module is electrically connected with the cathode of the X-ray tube.

10. The X-ray generator according to claim 9, wherein:

the layer or layers of shielding devices device further comprise a circuit channel, the high frequency and high voltage generator is electrically connected with the cathode and the anode of the X-ray tube via wires or interfaces passing through the circuit channel, and the filament power supplying module is electrically connected with the cathode of the X-ray tube via wires or interfaces passing through the circuit channel;

at least some of modules constituting the high frequency and high voltage generator are located between the case body and the layer or layers of shielding devices, and a power supply external to the case body and the rest of the modules constituting the high frequency and high voltage generator are located outside of the case body;

the case body is provided with a wire exit channel, and those of the modules constituting the high frequency and high voltage generator located in the case body are electrically connected with those modules located outside of the case body via wires or interfaces passing through the wire exit channel, or the high frequency and high voltage generator is electrically connected with the external power supply via wires or interfaces passing through the wire exit channel;

the layer or layers of shielding devices comprise a cylindrical body, a first end cover, and a second end cover, and wherein the first end cover and the second end cover are fixedly connected with two end openings of the cylindrical body, respectively;

at least one of the first end cover, the second end cover, and the cylindrical body is provided with a fluid channel and the circuit channel.

11. The X-ray generator according to claim 10, wherein: both of the first end cover and the second end cover are a dual-layer structure constituted by laminating an outer plate and an inner plate, and both of the first end cover and the second end cover are provided with the circuit channel, wherein:

the circuit channel provided in the first end cover comprises a cathode positioning aperture provided in the inner plate of the first end cover and a wire routing aperture provided in the outer plate of the second end cover, and in the X-ray tube, a sheath for protecting the cathode is embedded in the cathode positioning hole, and the wire routing aperture comprises a longitudinal aperture coincident with/parallel to the axial direction of the X-ray tube and a transverse aperture communicating with the longitudinal aperture, the axial direction of the transverse aperture being perpendicular to the axial direction of the longitudinal aperture, and the cathode of the X-ray tube is led out from the wire routing aperture from an inside of the sheath by two wires;

the circuit channel provided in the second end cover comprises anode positioning apertures provided in the inner plate and the outer plate of the second end cover, a conductive stud orderly passes through the anode positioning apertures provided in the outer plate and the inner plate of the second end cover, and the conductive stud is provided with an outer screw threaded portion which is engaged with an anode screw hole provided in the anode, the portion of the conductive stud far away from the anode is provided with a positioning screw hole, a conductive screw is provided with an outer screw threaded portion which is engaged with the positioning screw hole, and a wire electrically connected with the anode of the high frequency and high voltage generator is sandwiched between a head of the conductive screw and the conductive stud;

the inner plate of the second end cover is provided with at least one anode position-limit hole, the anode is provided with a position-limit screw hole, a positioning stud is provided with an outer screw threaded portion which is engaged with the position-limit screw hole, and the end of the positioning stud far away from the position-limit screw hole is inserted in the anode position-limit hole;

of the first end cover and the second end cover are provided with the fluid channels, both of the first end cover and the second end cover are the dual-layer structure constituted by the laminated outer plate and inner plate, there is a liquid flowing cavity between the outer plate and the inner plate, and both of the inner plate and the outer plate are provided with flow guiding orifices communicated with the liquid flowing cavity, and the fluid channel is constituted by the flow guiding orifices and the liquid flowing cavity;

the anode is in a hood shape and covers the end of a glass hood of the X-ray tube far away from the cathode, a liquid flowing space is provided between the anode and the outer circumferential surface of the glass hood of the X-ray tube, and the anode is provided with liquid circulating holes respectively communicating with the liquid flowing space and the flow guiding orifice provided in the inner plate of the second end cover.

12. The X-ray generator according to claim 11, wherein: the bent shape is a right-angle polygonal-line shape;

the case body comprises a main body portion, a first case cover and a second case cover, wherein:

the first case cover and the second case cover are fixedly provided at the two end openings of the main body portion, respectively;

constituent modules of the high frequency and high voltage generator comprise a first rectification and voltage regulation module, a high frequency inverter, a high voltage transformer and a voltage-doubling rectification module which are electrically connected with each other in this order, wherein:

the first rectification and voltage regulation module is electrically connected with the external power supply and is configured to take electrical energy required for loading a DC high voltage to the cathode and the anode of the X-ray tube from the external power supply;

the voltage-doubling rectification module is electrically connected with the cathode and the anode of the X-ray tube;

among the constituent modules of the high frequency and high voltage generator, at least the high voltage transformer and the voltage-doubling rectification module are fixedly provided between the case body and the shielding device;

the high voltage transformer is fixedly provided on the collimator, the first case cover, the second case cover or the shielding device, and the voltage-doubling rectification module is fixedly provided on a circuit board, wherein:

at least one of two ends of the circuit board bears against a position-limit protruding piece fixedly provided on the first case cover or the second case cover, and the circuit board is fixed on the position-limit protruding pieces by fasteners, or at least one of the two ends of the circuit board is inserted in a groove provided on the first case cover or the second case cover, and the middle region of the circuit board is fixed on the main body portion by fasteners.

13. The X-ray generator according to claim 12, wherein: the X-ray generator further comprises a monitor system, and the monitor system comprises a signal sampling module, a sampled-signal processing module, a logic decision and control module, and an auxiliary power supply module configured to supply power for the logic decision and control module, wherein:

the signal sampling module is located between the case body and the shielding device or is located within the shielding device;

the signal sampling module is used for detecting electric signals on the cathode or the anode of the X-ray tube, the temperature of the insulation liquid and the flow rate of the insulation liquid flowing into or flowing out of the case body, and sends the detected electric signals to the sampled-signal processing module;

the sampled-signal processing module is electrically connected with the signal sampling module and the logic decision and control module;

the sampled-signal processing module is configured for filtering the electric signals or converting the electric signals into the detection result in a digital form through analog-digital conversion and sending the detection result in a digital form to the logic decision and control module;

the logic decision and control module is also electrically connected with at least one of the high frequency and high voltage generator, the filament power supply module, and the cooling device;

the logic decision and control module automatically calls previously-stored control instructions according to the detection result based on predetermined correspondence rules between the detection result and the control instructions, and controls at least the output voltage or current of the high frequency and high voltage generator or the filament power supply module according to the control instructions, or controls power consumption of the cooling device according to the control instructions.

14. The X-ray generator according to claim 13, wherein: the filament power supply module comprises a second rectification and voltage regulation module electrically connected with the logic decision and control module, a filament inverter and a filament transformer electrically connected with the filament inverter and the cathode of the X-ray tube; the filament transformer is fixedly provided in the case body, and is configured to convert the voltage output from the filament inverter into a high frequency pulse voltage required for the cathode of the X-ray tube and to output the high frequency pulse voltage to the cathode of the X-ray tube;

the first rectification and voltage regulation module, the high frequency inverter, the logic decision and control module, the rectification and voltage regulation module, the filament inverter and the auxiliary power supply module are fixedly provided on the outer surface of the case body or in a control box provided outside of the case body;

the wires or interfaces passing through the wire exit channel provided in the case body are aviation plugs that provide liquid and gas seal between the inside of the case body and the outside of the case body, wherein the high voltage transformer and the high frequency inverter are electrically connected with each other via the aviation plugs, the signal sampling module and the sampled-signal processing module are electrically connected with each other via the aviation plugs or the filament inverter and the filament transformer are electrically connected with each other via the aviation plugs.

* * * * *